US009557690B2

(12) United States Patent
Hatano

(10) Patent No.: US 9,557,690 B2
(45) Date of Patent: Jan. 31, 2017

(54) IMAGE FORMING APPARATUS

(71) Applicant: CANON KABUSHIKI KAISHA, Tokyo (JP)

(72) Inventor: Fukashi Hatano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/004,066

(22) Filed: Jan. 22, 2016

(65) Prior Publication Data

US 2016/0216650 A1 Jul. 28, 2016

(30) Foreign Application Priority Data

Jan. 23, 2015 (JP) ..... 2015-011551

(51) Int. Cl.
*G03G 15/20* (2006.01)
*G03G 15/16* (2006.01)

(52) U.S. Cl.
CPC ..... *G03G 15/1615* (2013.01)

(58) Field of Classification Search
USPC ..... 399/121, 159, 162, 165, 297–303, 308, 399/313
See application file for complete search history.

(56) References Cited

U.S. PATENT DOCUMENTS 7,873,311 B2 * 1/2011 Hara ..... G03G 15/161 399/165
8,059,980 B2 * 11/2011 Okamoto ..... G03G 15/5029 399/313
8,433,221 B2 * 4/2013 Minbe ..... G03G 15/2032 399/121
8,737,891 B2 * 5/2014 Hanatani ..... G03G 15/1615 399/302
9,063,474 B2 6/2015 Ueno et al.

FOREIGN PATENT DOCUMENTS

JP 2009-075350 A 4/2009
JP 2009-128390 A 6/2009
JP 2011-013608 A 1/2011
JP 2014-106271 A 6/2014

* cited by examiner

*Primary Examiner* — Hoan Tran
(74) *Attorney, Agent, or Firm* — Fitzpatrick, Cella, Harper & Scinto

(57) ABSTRACT

An image forming apparatus includes a slider movable from a first position to a second position against a spring force for urging a primary transfer roller to an intermediary transfer belt to space the primary transfer roller from the intermediary transfer belt. An assisting mechanism assists the movement of the slider in a first direction. The assisting mechanism includes vertical and horizontal sliders which cause to apply the urging force of a compression spring to the slider as an urging force in the first direction, from a third position which is between the first position and the second position.

15 Claims, 11 Drawing Sheets

(a)

(b)

(a)

(b)

(a)

(b)

IMAGE FORMING APPARATUS

FIELD OF THE INVENTION AND RELATED ART

The present invention relates to an image forming apparatus such as a printing machine, a copying machine, a facsimile machine, and the like.

An image forming apparatus which employs an endless belt presses a transfer roller against a photosensitive drum, with the placement of the endless belt between the transfer roller and photosensitive drum, to form a transferring section in which a toner image formed on the photosensitive drum is transferred.

In the case of some image forming apparatuses which employ an endless belt, the endless belt is separated from the photosensitive drum when the image forming apparatus is switched in operational mode between the full-color mode and black monochromatic mode, and also, when a belt unit which comprises the endless belt is replaced, as disclosed in Japanese Laid-open Patent Application No. 2009-128390.

According to Japanese Laid-open Patent Application No. 2009-128390, multiple transfer rollers are kept pressed against the corresponding photosensitive drums by the pressure generated by springs, and a transfer roller supporting component which supports the transfer rollers in such a manner that the transfer rollers can be changed in position, are in engagement with a movable component which is attached to the frame of a belt unit so that it can be moved relative to the frame. Further, the transfer rollers are separated from the corresponding photosensitive drums against the force generated by the resiliency of the springs, by moving a rectangular component with the use of a cam.

In the case of the structure disclosed in Japanese Laid-open Patent Application No. 2009-128390, the force generated by the resiliency of the pressure applying means for keeping the transfer rollers pressured toward the endless belt becomes a large amount of load when the transfer rollers are separated from the endless belt. During the beginning stage of the process of separating the transfer rollers, the force generated by the resiliency of the pressure applying means is relatively small, and therefore, the amount of force necessary to drive the cam is also relatively small. However, as the movement of the movable component continues against the resiliency of the pressure applying means, the force generated by the pressure applying means gradually increases. Therefore, during the final stage of the process of separating the transfer rollers, the amount of force necessary to drive the cam to move the movable component becomes substantial.

Thus, it has been proposed to provide the movable component with an auxiliary pressure applying means which applies to the movable component, such pressure that is opposite in direction from the pressure generated by the primary pressure applying means. More concretely, a compression spring is disposed between the frame and movable component to press the movable component in the direction to separate the transfer roller.

However, in a case where the movable component is provided with the auxiliary pressure applying means alone, the auxiliary pressing means generates a large amount of pressure at the first position where the movable component begins to separate the transfer rollers. However, as the movable component is moved closer to the second position where the process ends, the auxiliary pressure applying means gradually reduces in the amount of the pressure it generates. Thus, the amount of force necessary to move the movable component when the movable component is in the adjacencies of the second position where the movable component is subjected to the large amount of force generated by the primary pressure applying means cannot be sufficiently reduced.

SUMMARY OF THE INVENTION

According to an aspect of the present invention, there is provided an image forming apparatus comprising an image bearing member configured to carry a toner image; an endless belt; a belt frame configured to support a plurality of stretching rollers for stretching said belt; a transfer roller provided inside of said belt configured to contact an inner surface of said belt to transfer the toner image from said image bearing member onto said belt; a first urging member provided between said belt frame and said transfer roller and configured to urge said transfer roller toward said image bearing member through said belt; a movable member movable relative to said belt frame in a first direction and movable between a first position for moving said transfer roller to a contact position where said transfer roller contacts and the inner surface of said belt and a second position for moving said transfer roller to a spaced position where said transfer roller is spaced from the inner surface of said belt; a driving source configured to move said movable member relative to said belt frame, said driving source receives a load attributable to said first urging member when said driving source moves said movable member from the first position to the second position; and a load reducing mechanism configured to reduce the load of said driving source when said driving source moves said movable member from a third position which is between the first position and the second position to the second position, said load reducing mechanism including a first member, a second urging member and a second member, wherein said first member is provided on said movable member so as to be movable in a second direction crossing with the first direction, and said first member includes a first contact portion, wherein said second urging member is disposed between said movable member and said first member and urges said first member in the second direction relative to said movable member, and wherein said second member is fixed to said belt frame and includes a second contact portion which contacts said first contact portion when said movable member is between the third position and the second position, wherein said second member is cooperative with said first member to convert an urging force of said second urging member to said first member in the second direction to a force to said movable member in the first direction, and the converted force in the first direction reduces the load of said driving source driving said movable member from the third position to the second position.

According to another aspect of the present invention, there is provided an image forming apparatus comprising an image bearing member configured to carry a toner image; an endless belt; a belt frame configured to support a plurality of stretching rollers for stretching said belt; a transfer roller provided inside of said belt configured to contact an inner surface of said belt to transfer the toner image from said image bearing member onto said belt; a first urging member provided between said belt frame and said transfer roller and configured to urge said transfer roller toward said image bearing member through said belt; a movable member movable relative to said belt frame in a first direction and movable between a first position for moving said transfer roller to a contact position where said transfer roller contacts and the inner surface of said belt and a second position for moving said transfer roller to a spaced position where said transfer roller is spaced from the inner surface of said belt; a driving source configured to move said movable member relative to said belt frame, said driving source receives a load attributable to said first urging member when said driving source moves said movable member from the first position to the second position; and a load reducing mechanism configured to reduce the load of said driving source when said driving source moves said movable member from a third position which is between the first position and the second position to the second position, said load reducing mechanism including a first member, a second urging member and a second contact portion, wherein said first member is provided on said belt frame so as to be movable in a second direction crossing with the first direction, and said first member includes a first contact portion, wherein said second urging member is disposed between said belt frame and said first member and urges said first member in the second direction relative to said belt frame, and wherein said second member is provided on said movable member and contacts said first contact portion when said is between the third position and the second position, wherein said second member is cooperative with said first member to convert an urging force of said second urging member to said first member in the second direction to a force to said movable member in the first direction, and the converted force in the first direction reduces the load of said driving source driving said movable member from the third position to the second position.

According to a further aspect of the present invention, there is provided an image forming apparatus comprising an image bearing member configured to carry a toner image; an endless belt; a belt frame configured to support a plurality of stretching rollers, including a first stretching roller and a second stretching roller, for stretching said belt; a transfer roller provided inside of said belt configured to contact an inner surface of said belt to transfer the toner image from said image bearing member onto said belt; a first urging member provided between said belt frame and said transfer roller and configured to urge said transfer roller toward said image bearing member through said belt; a movable member movable relative to said belt frame in a first direction and movable between a first position for moving said transfer roller to a contact position where said transfer roller contacts and the inner surface of said belt and a second position for moving said transfer roller to a spaced position where said transfer roller is spaced from the inner surface of said belt; a driving source configured to move said movable member relative to said belt frame, said driving source receives a load attributable to said first urging member when said driving source moves said movable member from the first position to the second position; and a load reducing mechanism configured to reduce the load of said driving source when said driving source moves said movable member from a third position which is between the first position and the second position to the second position, said load reducing mechanism including said first stretching roller, a second urging member and a second contact portion, wherein said first stretching roller is provided on said belt frame so as to be movable in a second direction crossing with the first direction, and said first member includes a first contact portion, wherein said second urging member is disposed between said belt frame and said second stretching roller and urges said first stretching roller in the second direction through said belt relative to said belt frame, and wherein said second contact portion is provided on said movable member and contacts said first contact portion when said movable member is between the third position and the second position, wherein said second member is cooperative with said first stretching roller to convert an urging force of said second urging member to said first stretching roller in the second direction to a force to said movable member in the first direction, and the converted force in the first direction reduces the load of said driving source driving said movable member from the third position to the second position.

Further features of the present invention will become apparent from the following description of exemplary embodiments with reference to the attached drawings.

Figure 6:
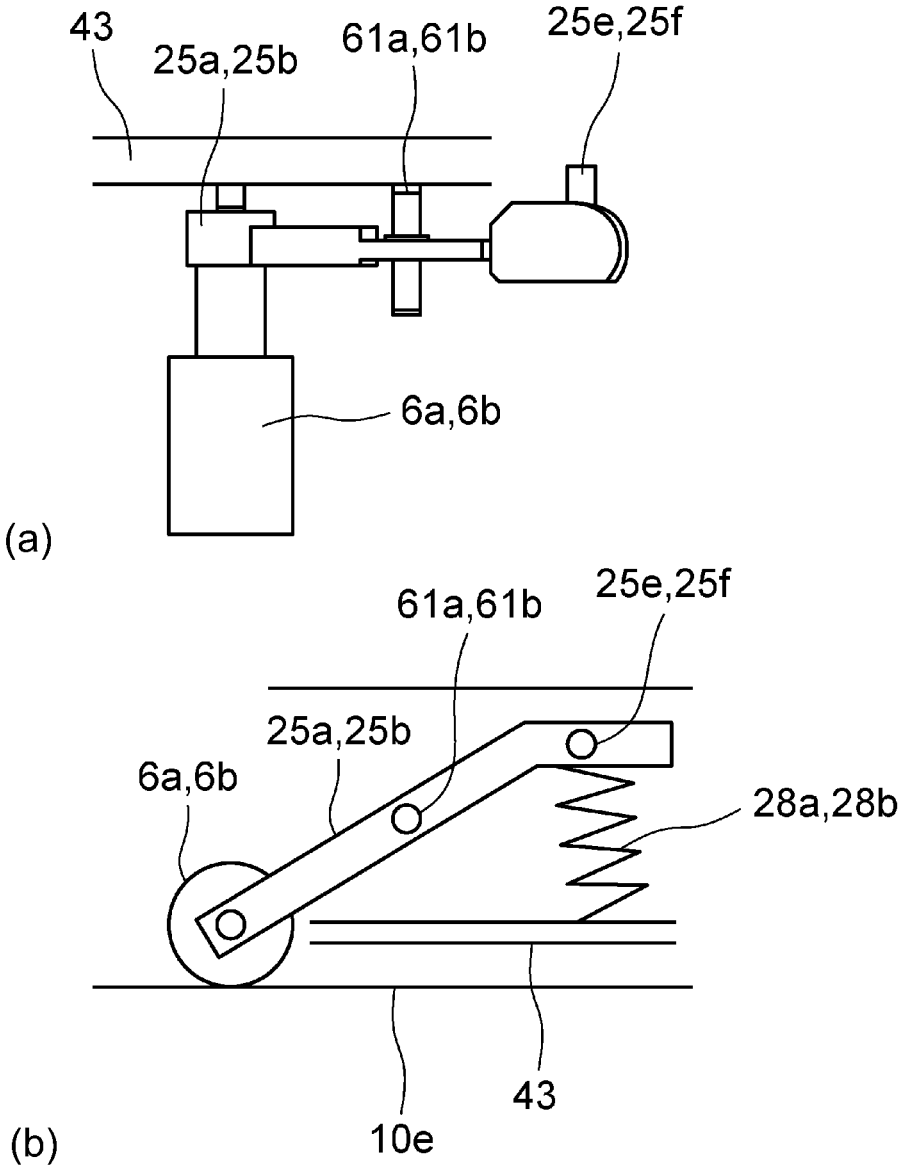

Parts (a) and (b) of FIG. 6 illustrate the rotationally movable primary transfer roller holder.

Figure 7:
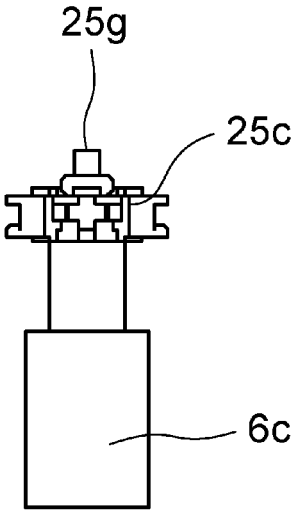
Figure 7:
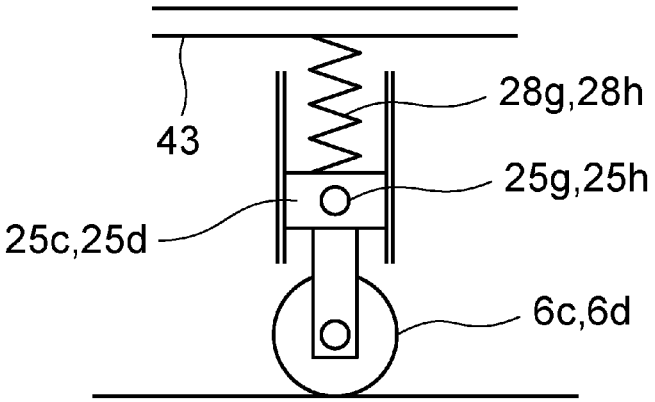

Parts (a) and (b) of FIG. 7 illustrate the linearly movable primary transfer roller holder.

Figure 8:
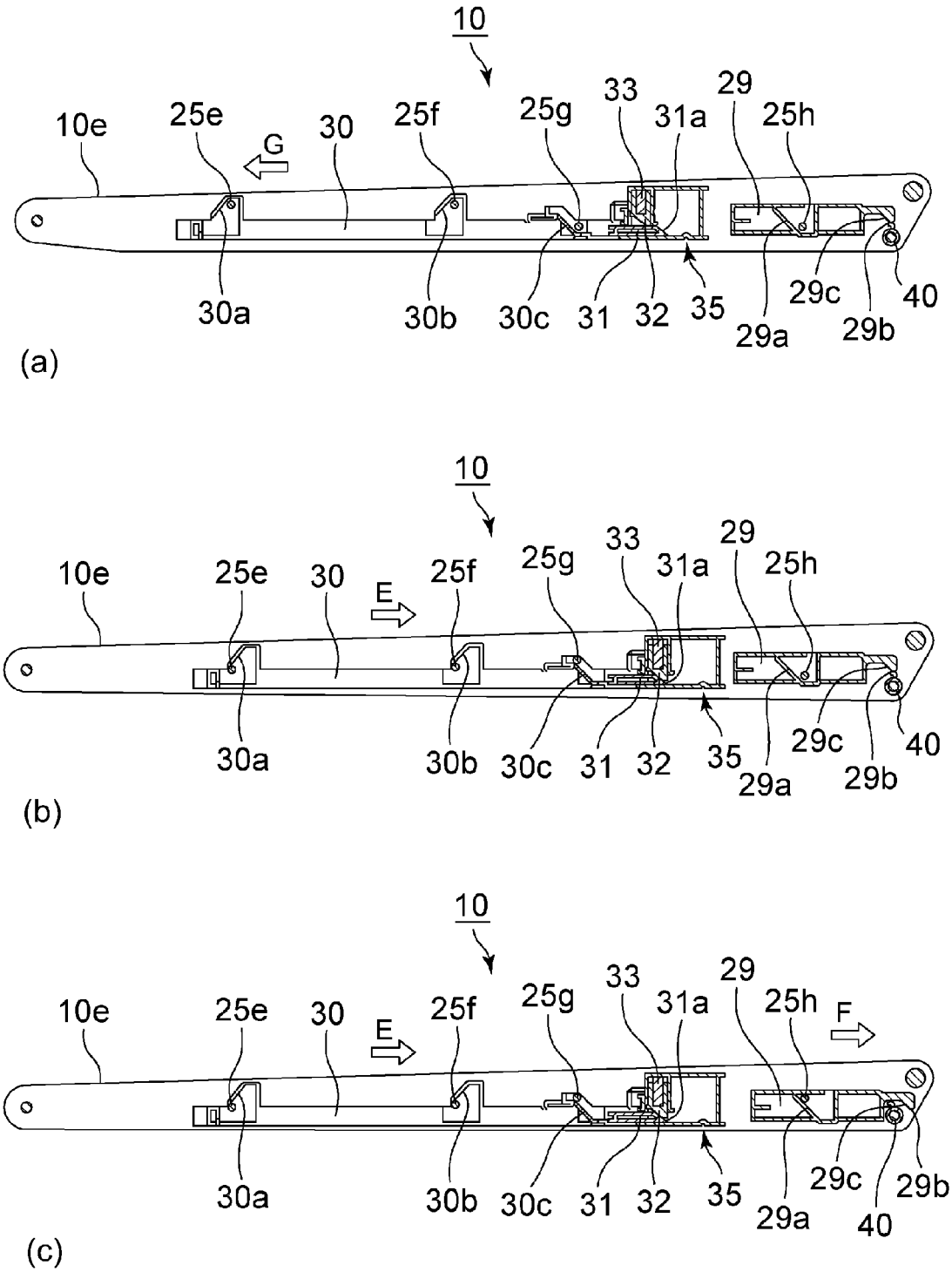

Parts (a), (b) and (c) of FIG. 8 illustrate the relationship between the rotational angle of the cam and the slider position.

Figure 9:
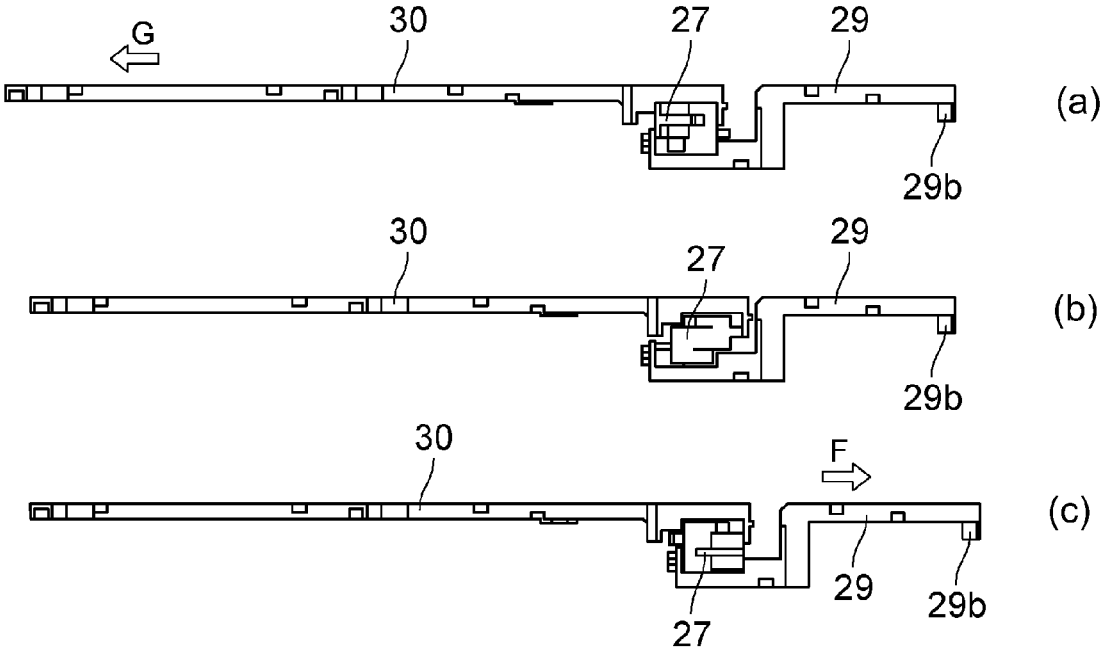

Parts (a), (b) and (c) of FIG. 9 illustrate the cam movement in each of the operational mode of the image forming apparatus.

Figure 10:
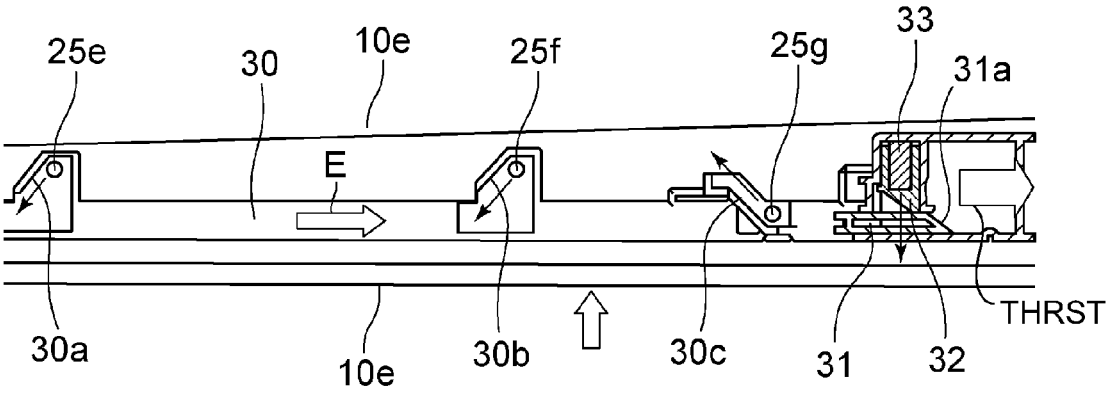

FIG. 10 is a drawing for describing the operation of the assisting mechanism, which occurs when the image forming apparatus is switched in the operational mode to the full-separation mode.

Figure 11:
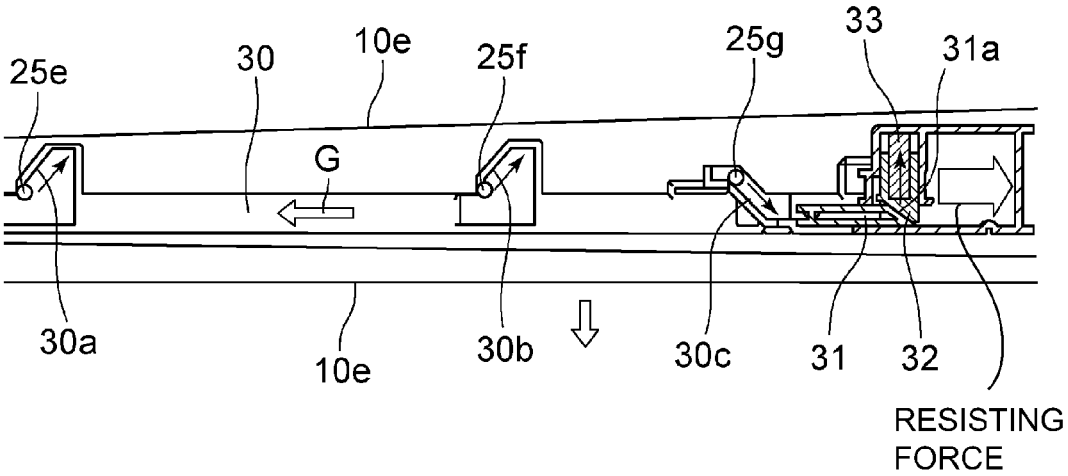

FIG. 11 is a drawing for describing the operation of the assisting mechanism, which occurs when the image forming apparatus is switched in operational mode to the full-color mode.

Figure 12:
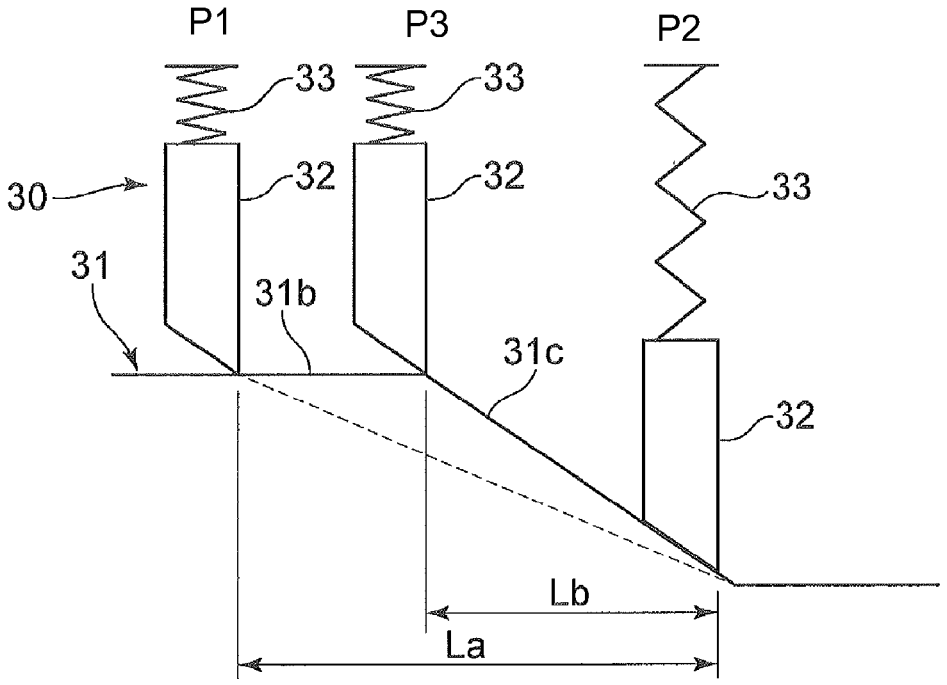
Figure 12:
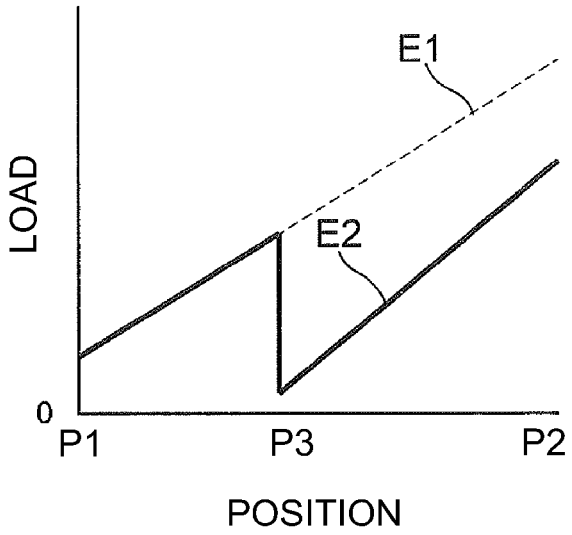

Parts (a) and (b) of FIG. 12 illustrate the force generated by the assisting mechanism.

Figure 13:
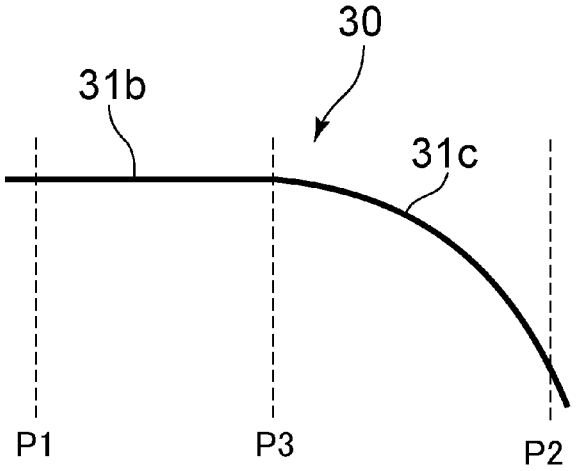

FIG. 13 is a drawing for describing another configuration of the mating surface of the horizontal slider.

Figure 14:
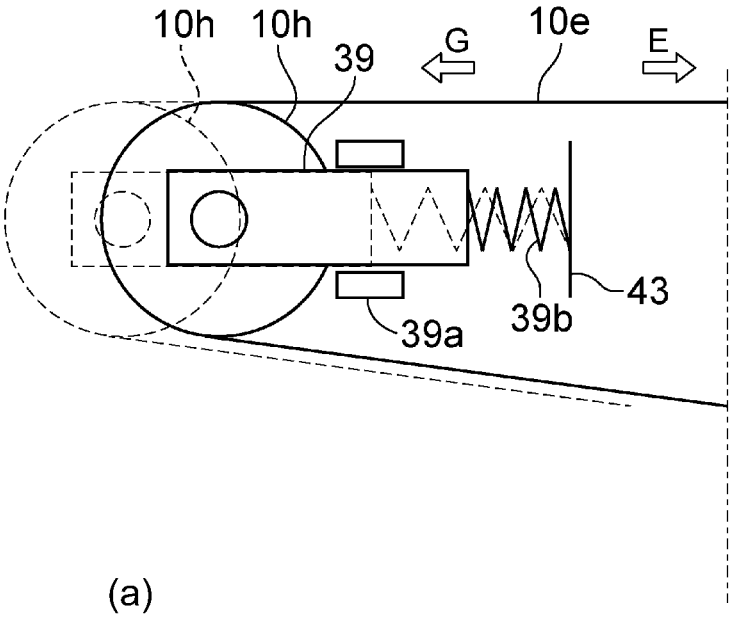
Figure 14:
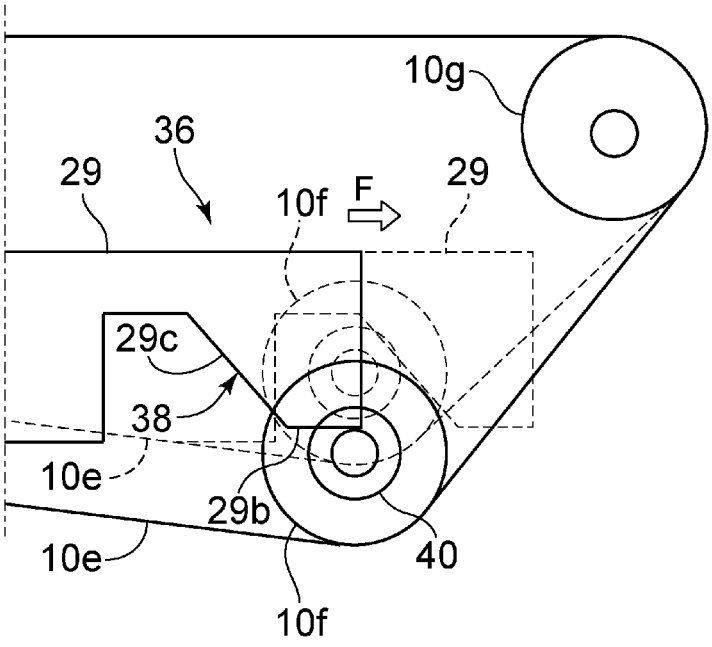

Parts (a) and (b) of FIG. 14 illustrate the assisting mechanism in the second embodiment of the present invention.

Figure 15:
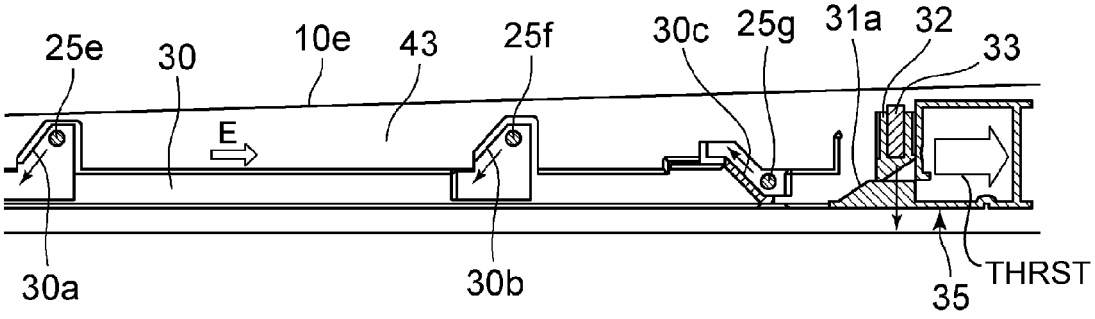

FIG. 15 is a drawing for describing the operation of the assisting mechanism, which occurs as the image forming apparatus is switched in operational mode to the black monochromatic mode.

Figure 16:
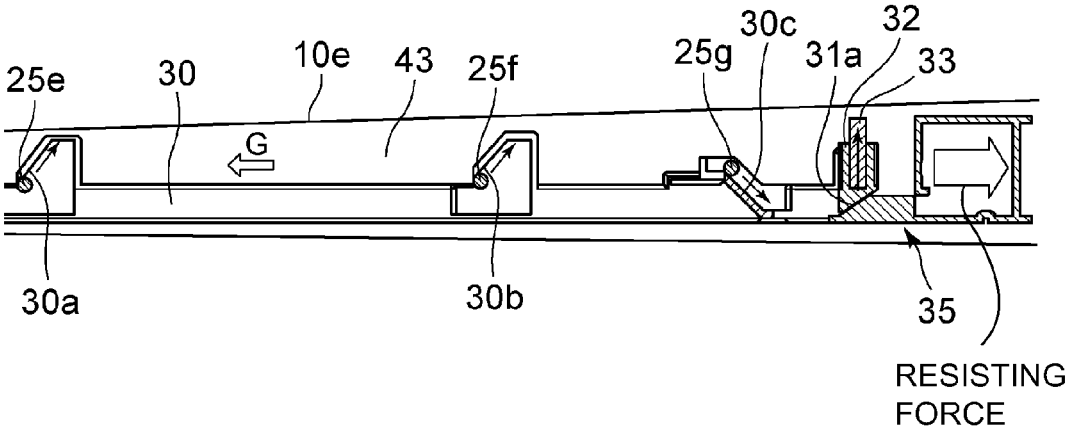

FIG. 16 is a drawing for describing the operation of the assisting mechanism, which occurs as the image forming apparatus is switched in operational mode to the full-color mode.

DESCRIPTION OF THE EMBODIMENTS

Hereinafter, the image forming apparatuses in the preferred embodiments of the present invention are described in detail with reference to appended drawings.

Embodiment 1

Image Forming Apparatus

Figure 1:
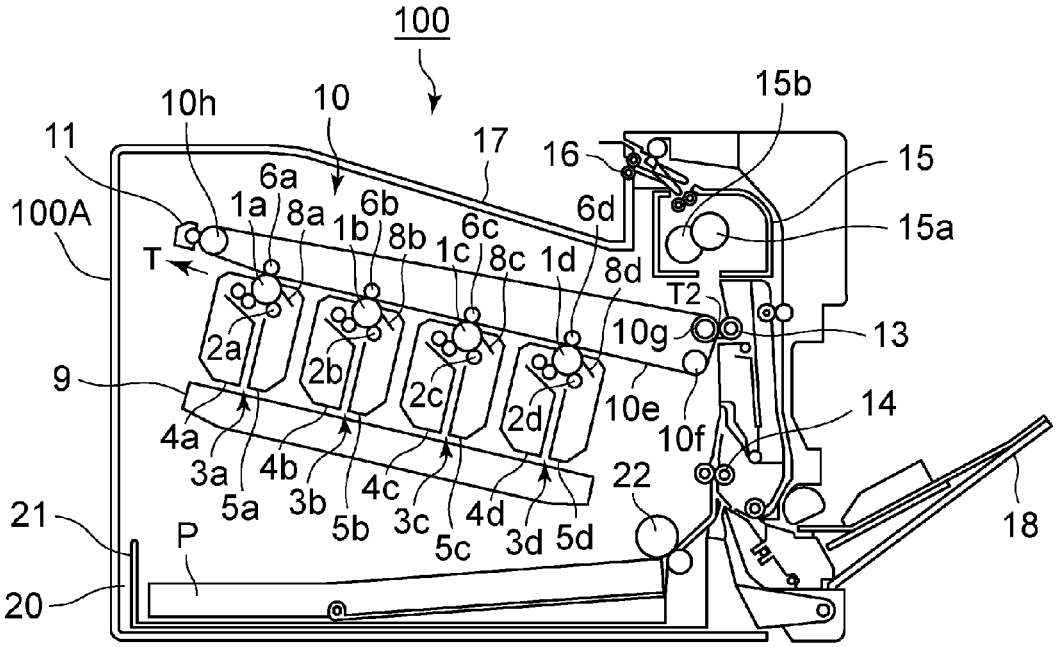
FIG. 1 is drawing for describing the structure of a typical image forming apparatus which is compatible with the present invention.

FIG. 1 is a drawing for describing the structure of the image forming apparatus in this embodiment. Regarding the orientation of the image forming apparatus 100, and its structural component, in this embodiment, the side which corresponds to the surface of the sheet of paper on which FIG. 1 is present, will be referred to as "front side", whereas the side which corresponds to the back surface of the sheet of paper on which FIG. 1 is present, will be referred to as "back side".

Referring to FIG. 1, the image forming apparatus 100 is a full-color printer of the so-called tandem type. More concretely, it has an intermediary transfer unit 10, and four image forming sections 3*a*, 3*b*, 3*c* and 3*d*, which are aligned along the upwardly facing portion of the outward surface of the intermediary transfer belt 10*e*. In the image forming section 3*a*, a yellow toner image is formed on a photosensitive drum 1*a*, and is transferred onto the intermediary transfer belt 10*e*. In the image forming section 3*b*, a magenta toner image is formed on a photosensitive drum 1*b*, and is transferred onto the intermediary transfer belt 10*e*. In the image forming sections 3*c* and 3*d*, cyan and black toner images are formed on photosensitive drums 1*c* and 1*d*, respectively, and are transferred onto the intermediary transfer belt 10*e*.

After the transfer of the four monochromatic toner images, different in color, onto the intermediary transfer belt 10*e*, the four toner images are conveyed to the secondary transferring section T2, in which they are transferred (secondary transfer) onto a sheet P of recording medium. A separation roller 22 pulls out sheets P of recording medium one by one from a recording medium cassette 21 while separating from the rest. Then, it sends the sheet P to a pair of registration rollers 14, which send the sheet P to the secondary transferring section T2 in synchronism with the timing with which the toner images on the intermediary transfer belt 10*e* arrive at the secondary transferring section T2. After the transfer (secondary transfer) of the four monochromatic toner images, different in color, onto the sheet P, the sheet P is sent to a fixing device 15, in which the sheet P and the toner images thereon are heated and pressed. Thus, the four toner images become fixed to the sheet P. Thereafter, the sheet P is discharged into a delivery tray 17 by a pair of discharge rollers 16.

A secondary transfer roller 13 is positioned so that it opposes a driver roller 10*g*, with the presence of the intermediary transfer belt 10*e* between itself and driver roller 10*g*. It forms the secondary transferring section T2 between the intermediary transfer belt 10*e* and secondary transfer roller 13. The driver roller 10*g* is grounded. As positive DC voltage is applied to the secondary transfer roller 13 from an unshown secondary transfer power source, the toner images are transferred (secondary transfer) onto the sheet P of recording medium from the intermediary transfer belt 10*e*.

The fixing device 15 has: a heating roller 15*b* which has an internal heater; and a pressure roller 15*a*. The heating roller 15*b* and pressure roller 15*a* form a section which heats and presses the sheet P and the toner images thereon, by being pressed upon each other. A belt cleaning apparatus 11 is positioned so that it opposes a tension roller 10*h*, with the presence of the intermediary transfer belt 10*e* between itself and tension roller 10*h*. It removes the transfer residual toner, which is the toner remaining adhered to the intermediary transfer belt 10*e* on the downstream side of the secondary transferring section T2 in terms of the moving direction of the intermediary transfer belt 10*e* after the secondary transfer, by scraping the intermediary transfer belt 10*e* with its cleaning blade.

(Image Forming Section)

The image forming sections 3*a*, 3*b*, 3*c* and 3*d* are roughly the same in structure although they are different in the color of the toner (yellow, magenta, cyan, and black, respectively) which their developing devices 4*a*, 4*b*, 4*c* and 4*d*, respectively, use. Hereafter, therefore, only the image forming section 3*a* is described in order not to repeat the same description; the image forming sections 3*b*, 3*c* and 3*b* are not described.

The image forming section 3*a* has a photosensitive drum 1*a*. It has also a charge roller 2*a*, an exposing device 9, a developing device 4*a*, a primary transfer roller 6*a*, and a drum cleaning device 8*a*, which surround the photosensitive drum 1*a*. The photosensitive drum 1*a* is an electrophotographic photosensitive component. It rotates at a preset process speed.

To the charge roller 2*a*, alternating voltage, which is a combination of positive DC voltage and AC voltage, is applied to uniformly charge the photosensitive drum 1*a* to the negative polarity. The exposing device 9 writes an electrostatic image on the peripheral surface of the photosensitive drum 1*a*, by scanning the peripheral surface of the photosensitive drum 1*a* with a beam of laser light it outputs, while modulating (turning on or off) the beam, in response to the image formation signals obtained based on the data of yellow component of an image to be formed. The developing device 4*a* positively charges the toner in two-component developer which is a combination of toner and carrier, by stirring the developer, and develops the electrostatic image into a visible image, that is, an image formed of toner, by causing the charged toner to transfer onto the photosensitive drum 1*a*. To the primary transfer roller 6*a*, positive DC voltage is applied to transfer the toner image on the photosensitive drum 1*a*, onto the intermediary transfer belt 10*e*. The drum cleaning device 8*a* removes the transfer residual toner from the peripheral surface of the photosensitive drum 1*a* by scraping the peripheral surface of the photosensitive drum 1*a* with its cleaning blade.

The image forming sections 3*a*, 3*b*, 3*c* and 3*d* are in the form of a replaceable unit. They are independently replaceable from each other. That is, they can be independently pulled out of the image forming apparatus 100 from the front side of the image forming apparatus 100, to be replaced. The image forming apparatus 100 is also provided with an intermediary transfer unit 10, which is disposed so that it opposes the image forming sections 3*a*, 3*b*, 3*c* and 3*d*. The intermediary transfer unit 10 can be pulled out of the housing 100A of the image forming apparatus 100 in the rightward direction to be replaced.

As described above, the photosensitive drum 1*a*, which is an example of image bearing component, contacts the intermediary transfer belt 10*e* as the intermediary transfer belt 10*e* is pressed by the primary transfer roller 6*a*. The housing 100A of the image forming apparatus 100 supports not only the photosensitive drum 1*a*, but also, the intermediary transfer unit 10, which is an example of belt unit, in such a manner that the intermediary transfer unit 10 can be inserted into, or pulled out of, the housing 100A.

(Intermediary Transfer Unit)

Figure 2:
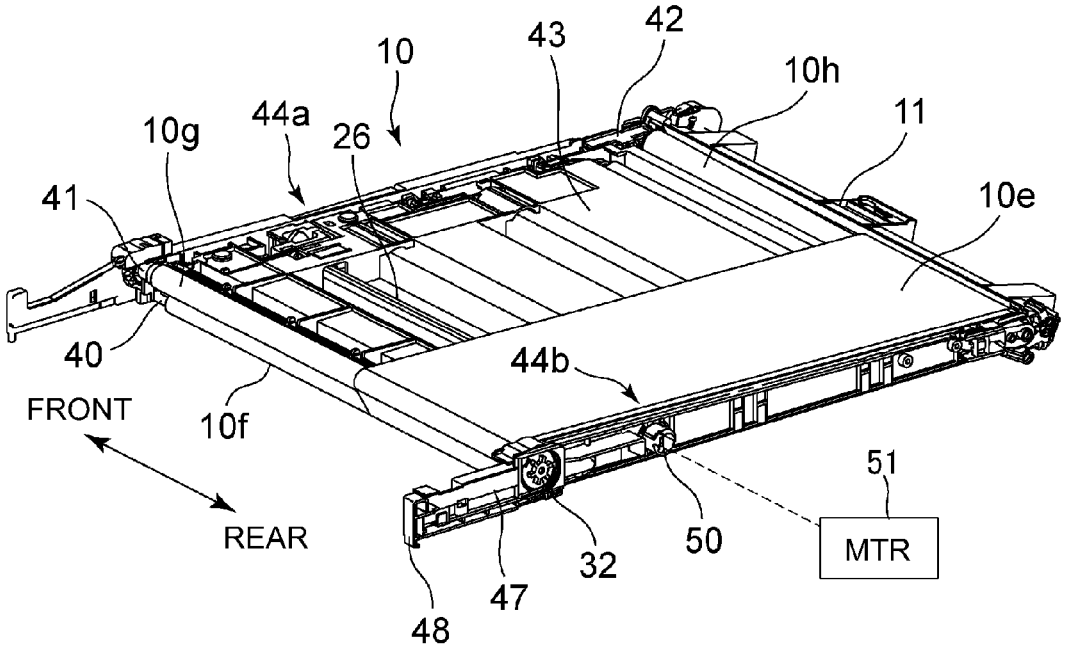
FIG. 2 is a perspective view of a typical intermediary transfer unit which is compatible with the present invention.

FIG. 2 is a perspective view of the intermediary transfer unit 10. FIG. 2 does not show a part of the front side of the intermediary transfer belt 10*e*. Referring to FIG. 1, the intermediary transfer belt 10*e* is driven (circularly moved)

by a driver roller 10*g* in the counterclockwise direction as indicated in FIG. 1. The rotational axis of each of the driver roller 10*g*, an idler roller 10*f*, and a tension roller 10*h* is roughly parallel to the depth direction of the image forming apparatus 100, that is, a straight line which is perpendicular to the front and rear surfaces of the image forming apparatus 100. The widthwise direction of the intermediary transfer belt 10*e*, which is roughly perpendicular to the direction in which the intermediary transfer belt 10*e* is circularly driven, may be referred to as "thrust direction", hereafter.

Referring to FIG. 2, the intermediary transfer unit 10 is an example of a belt moving device. It suspends and keeps tensioned the intermediary transfer belt 10*e*, which is an example of a component in the form of a belt, with the use of the driver roller 10*g*, idler roller 10*f*, and tension roller 10*h*, which are examples of belt supporting-tensioning roller. The driver roller 10*g*, idler roller 10*f*, and tension roller 10*h* (which are examples of suspending-tensioning component), and primary transfer rollers 6*a*, 6*b*, 6*c* and 6*d*, are rotationally supported by the frame 43 of the intermediary transfer unit 10, at their lengthwise ends.

The intermediary transfer belt 10*e* is 300 μm in thickness, 350 mm in width, and 700 mm in length (circumferential length). It is an endless belt which is made of a single layer of polyimide resin. The driver roller 10*g* is rotatably supported at its lengthwise ends in terms of the direction parallel to its rotational axis, by a pair of driver roller bearings 41 (FIG. 2 shows only front one). The surface layer of the driver roller 10*g* is formed of such rubber that is high in coefficient of friction, in order to eliminate the slippage between the driver roller 10*g* and intermediary transfer belt 10*e*. The driver roller 10*g* is rotated by the driving force transmitted thereto from an unshown motor. As the driver roller 10*g* is rotationally driven, the intermediary transfer belt 10*e* is circularly moved.

The idler roller 10*f* is rotatably supported at its lengthwise ends in terms of the direction parallel to its rotational axis, by a pair of idler roller bearings 40 (FIG. 2 shows only front one). The idler roller 10*f* is rotated by the circular movement of the intermediary transfer belt 10*e*.

The tension roller 10*h* is rotatably supported at its lengthwise ends in terms of its rotational axis by a pair of tension roller bearings 42 (FIG. 2 shown only front side). The tension roller bearings 42 are attached to the frame 34 in such a manner that they can be moved (slid) in the direction in which the intermediary transfer belt 10*e* is kept stretched. Further, the tension roller bearings 42 remain under the pressure generated by a pair of unshown springs (compression springs) in the direction to press the intermediary transfer belt 10*e* outward from within the loop the intermediary transfer belt 10*e* forms, in the direction parallel to the direction in which the intermediary transfer belt 10*e* is stretched. Thus, they move (slide) in the direction parallel to the direction in which the intermediary transfer belt 10*e* is stretched.

As the tension roller bearings 42 slide outward of the belt loop in the direction parallel to the direction in which the intermediary transfer belt 10*e* is stretched, the tension roller 10*h* presses the intermediary transfer belt 10*e* outwards of the belt loop, providing thereby the intermediary transfer belt 10*e* with tension.

Referring to FIG. 1, the tension roller 10*h* provides the intermediary transfer belt 10*e* with a preset amount of tension, by being pressured in the outward direction of the belt loop, as indicated by an arrow mark T in FIG. 1, from within the belt loop. The belt cleaning device 11 is positioned so that it opposes the tension roller 10*h* with the presence of the intermediary transfer belt 10*e* between itself and the tension roller 10*h*.

The primary transfer rollers 6*a*, 6*b*, 6*c* and 6*d* are pressed toward the photosensitive drum 1*a*, 1*b*, 1*c* and 1*d*, respectively, with the presence of the intermediary transfer belt 10*e* between the primary transfer rollers 6 and photosensitive drums 1, being thereby placed in contact with the inward surface of the intermediary transfer belt 10*e*. Thus, as the intermediary transfer belt 10*e* is circular moved, the primary transfer rollers 6 are rotated by the intermediary transfer belt 10*e*. The primary transfer rollers 6*a*, 6*b*, 6*c* and 6*d* are pressed against the photosensitive drums 1*a*, 1*b*, 1*c* and 1*d* with the presence of the intermediary transfer belt 10*e* between the primary transfer rollers 6 and photosensitive drums 1, forming thereby primary transferring sections between themselves and intermediary transfer belt 10*e*, one for one. Each of the primary transfer rollers 6*a*, 6*b*, 6*c* and 6*d* is made up of a metallic core (shaft), and an elastic layer formed of electrically conductive rubber around the metallic core. It is 16 mm in diameter.

(Black Monochromatic Mode, and Full-Separation Mode)

Referring to FIG. 1, there are certain situations in which the intermediary transfer unit 10 needs to keep the intermediary transfer belt 10*e* separated from the photosensitive drums 1*a*, 1*b*, 1*c* and 1*d*. More specifically, in the black monochromatic mode, the intermediary transfer unit 10 places only the photosensitive drum 1*d* in contact with the intermediary transfer belt 10*e*, and keeps the intermediary transfer belt 10*e* separated from the photosensitive drums 1*a*, 1*b* and 1*c*. In the full-separation mode which allows the intermediary transfer belt 10 to be pulled out of the housing 100A of the image forming apparatus 100, the intermediary transfer unit 10 keeps the intermediary transfer belt 10*e* separated from all the photosensitive drums 1*a*, 1*b*, 1*c* and 1*d*.

When it is a full-color image that is to be formed by the image forming apparatus 100, the image forming apparatus 100 is set in the full-color mode, and the image forming sections 3*a*, 3*b*, 3*c* and 3*d* are all used to form the image as described above. Therefore, it is necessary that the intermediary transfer belt 10*e* is kept in contact with all the photosensitive drums 1*a*, 1*b*, 1*c* and 1*d*. In comparison, when it is a black monochromatic image that is to be formed by the image forming apparatus 100, the image forming apparatus 100 is set in the black monochromatic mode, in which only the image forming section 3*d* is used to form the image. Therefore, it is unnecessary for the intermediary transfer belt 10*e* to be kept in contact with the photosensitive drums 1*a*, 1*b* and 1*c*.

Therefore, when the black monochromatic mode is set, the primary transfer rollers 6*a*, 6*b* and 6*c*, are moved into the positions where they remain separated from the photosensitive drums 1*a*, 1*b* and 1*c*, as well as the intermediary transfer belt 10*e*. In the black monochromatic mode, the image forming sections 3*a*, 3*b* and 3*c*, are kept inactive to keep the developer from being wastefully stirred in the developing devices 4*a*, 4*b* and 4*c*, in order to prevent the image forming sections 3*b*, 3*c* and 3*d* from being reduced in life span by the wasteful operation, and also, to extend in life span the photosensitive drums 1*a*, 1*b* and 1*c*, and the primary transfer rollers 6*a*, 6*b* and 6*c*.

Further, there are certain situations in which the intermediary transfer unit 10 needs to be pulled out of the image forming apparatus 100 having the image forming sections 3*a*, 3*b*, 3*c* and 3*d*, in order to replace the intermediary transfer unit 10 with a brand-new intermediary transfer unit 10. When it is necessary to replace the intermediary transfer unit 10, the image forming apparatus 100 is set in the full-separation mode in order to prevent the photosensitive drums 1*a*, 1*b*, 1*c* and 1*d*, and the intermediary transfer belt 10*e*, from sustaining frictional scars when the intermediary transfer unit 10 is pulled out of the housing 100A of the image forming apparatus 100.

As the image forming apparatus 100 is set in the full-separation mode, the primary transfer rollers 6*a*, 6*b*, 6*c* and 6*d* are moved away from the photosensitive drums 1*a*, 1*b*, 1*c* and 1*d*, respectively, allowing thereby the intermediary transfer belt 10*e* to be separated from the photosensitive drums 1*a*, 1*b*, 1*c* and 1*d*. That is, the primary transfer rollers 6*a*, 6*b*, 6*c* and 6*d* automatically move into the positions where they remain separated from the photosensitive drums 1*a*, 1*b*, 1*c* and 1*d*. Further, the idler roller 10*f* retracts upward, creating gaps between the intermediary transfer belt 10*e* and photosensitive drums 1*a*, 1*b*, 1*c* and 1*d*.

(Primary Transfer Roller Separation Mechanism)

Figure 3:
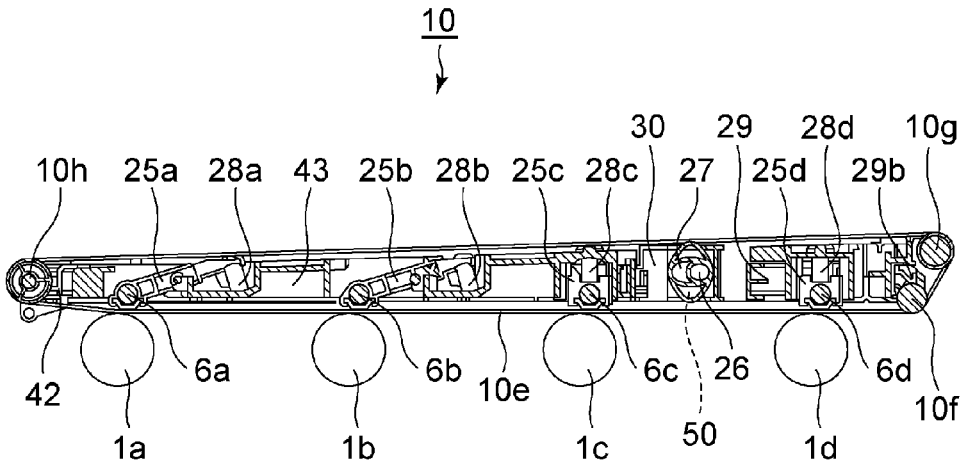
FIG. 3 is a sectional view of a primary transfer roller separation mechanism, at a vertical plane which is perpendicular to the rotational axis of each primary transfer roller. It is for describing the mechanism.

FIG. 3 is a sectional view of the primary roller separation mechanism, at a plane perpendicular to the rotational axis of the primary transfer roller 6*a* (6*b*, 6*c* and 6*d*).

Referring to FIG. 2, the back side of the image forming apparatus 100 is provided with a motor 51. As driving force is inputted into a separation coupling 50 from the gear train of the motor 51 through an unshown coupling, the primary transfer roller separation mechanism 44*a* and 44*b* are activated. The separation coupling 50 rotates a shaft 26 which is disposed in parallel to the driver roller 10*g*, idler roller 10*f*, and tension roller 10*h*, whereby it causes the primary transfer roller separation mechanisms 44*a* and 44*b* with which the frame 43 of the intermediary transfer unit 10 is provided, to operate.

Referring to FIG. 3, the primary transfer rollers 6*a* and 6*b* are supported by their shaft, by the primary transfer roller holders 25*a* and 25*b* which are rotatably supported by the frame 43. The pressure application springs 28*a* and 28*b* are disposed between the primary transfer roller holder 25*a* and 25*b* and the frame 43, respectively. They press the primary transfer rollers 6*a* and 6*b* toward the photosensitive drums 1*a* and 1*b* with the application of a total pressure of 7 N (0.7 kgf).

The primary transfer rollers 6*c* and 6*d* are supported by their shaft, by the primary transfer roller holders 25*c* and 25*d* which are supported by the frame 43 so that they are allowed to linearly move relative to the frame 43. The pressure applying springs 28*c* and 28*d* are disposed between the primary transfer roller holder 25*c* and 25*d* and the frame 43. They press the primary transfer rollers 6*c* and 6*d* toward the photosensitive drums 1*c* and 1*d*, respectively.

As the separation coupling 51 disposed on the back side of the intermediary transfer unit 10 is rotationally driven by the motor 51, the shaft 26 fixed to the separation coupling 50 rotates, whereby the primary transfer rollers 6 are pressed upon, or moved away from, the inward surface of the intermediary transfer belt 10*e*. The lengthwise ends of the shaft 26 are fitted with a pair of cams 27, one for one, which transmit driving force to the sliders 29 and 30. The motor 51 moves the sliders 29 and 30 by rotating the cams 27.

(Cam)

Figure 4:
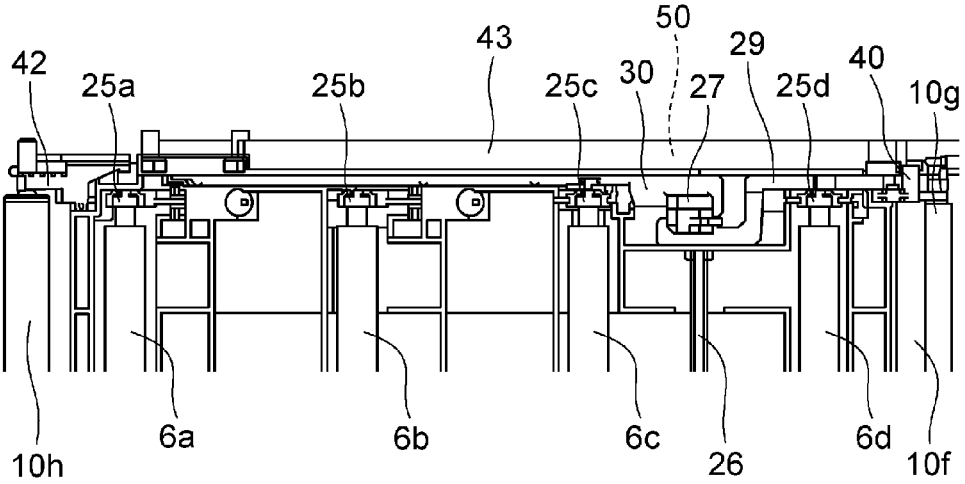
FIG. 4 is a drawing for describing the engagement between the cam and slider.
Figure 5:
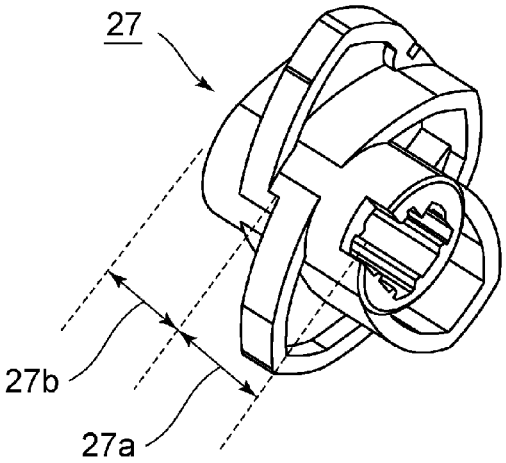
FIG. 5 is a perspective view of the cam.

FIG. 4 is a drawing for describing the engagement between the cam and slider. FIG. 5 is a perspective view of one of the cams 27. Referring to FIG. 4, the sliders 29 and 30 are in engagement with the cam 27. As the cam 27 is rotated by the shaft 26, the sliders 29 and 30 move in the left or right direction of FIG. 3. More concretely, as the cam 27 is driven, the slider 30 which is an example of the first movable component, is moved by the cam 27 in the direction to place the primary transfer rollers 6*a*, 6*b* and 6*c*, in contact with the intermediary transfer belt 10, or separate the primary transfer roller 6*a*, 6*b* and 6*c*, from the intermediary transfer belt 10*e*. The slider 29 which is an example of the second movable component is driven by the cam 27 in the direction to place primary transfer roller 6*d* in contact with the intermediary transfer belt 10*e*, or separate the primary transfer roller 6*d* from the intermediary transfer belt 10*e*.

Referring to FIG. 5, the cam 27 is provided with three controlling surfaces which are angled by 120° relative to the adjacent controlling surfaces. More concretely, the cam 27 is provided with a controlling surface 27*b* for the slider 29, and a controlling surface 27*a* for the slider 30. That is, the cam 27 has the controlling surfaces 27*a* and 27*b* for enabling a user to select the full-color mode, black monochromatic mode, or full-separation mode.

(Primary Transfer Roller Holder)

Parts (a) and (b) of FIG. 6 illustrate the primary transfer roller holder, which is rotationally movable. Parts (a) and (b) of FIG. 7 illustrate the primary transfer roller holder, which is linearly movable. Referring to FIG. 3, the frame 43, which is an example of frame, rotatably supports the rollers by which the intermediary transfer belt 10*e* is suspended and kept tensioned. The primary transfer roller holder 25*a*, which is an example of supporting mechanism, supports the primary transfer roller 6*a* in such a manner that the primary transfer roller 6*a* can be placed in contact with, or separated from, the intermediary transfer belt 10*e*.

Referring to part (a) of FIG. 6, the primary transfer roller holders 25*a* and 25*b* have protrusions 25*e* and 25*f*, respectively. Referring to part (b) of FIG. 6, as the protrusions 25*e* and 25*f* are pressed downward against the force generated by the resiliency of the pressure application springs 28*a* and 28*b*, the primary transfer roller 6*a* and 6*b* move upward, separating thereby from the intermediary transfer belt 10*e*.

Referring to part (a) of FIG. 7, the primary transfer roller holders 25*c* and 25*d* have protrusions 25*g* and 25*h*, respectively. Referring to part (b) of FIG. 7, as the protrusions 25*g* and 25*h* are pushed upward against the resiliency of the presser application springs 28*c* and 28*d*, the primary transfer rollers 6*c* and 6*d* move upward, separating thereby from the intermediary transfer belt 10*e*.

(Slider)

Parts (a), (b) and (c) of FIG. 8 illustrate the relationship between the rotational angle of the cam 27 and the position of the sliders. Referring to FIG. 4, the slider 30 moves the primary transfer rollers 6*a*, 6*b* and 6*c*, by engaging the primary transfer roller holders 25*a*, 25*b* and 25*c*.

Referring to part (a) of FIG. 8, in the full-color mode, the slider 30 does not move the primary transfer rollers 6*a*, 6*b* and 6*c*. The protrusions 25*e*, 25*f* and 25*g* are kept in contact with the slanted surfaces 30*a*, 30*b* and 30*c* by the force (pressure) generated by the compression springs 28*a*, 28*b* and 28*c* shown in FIG. 3.

When the image forming apparatus 100 is changed in operational mode from the full-color mode to the black monochromatic mode, the slider 30 is moved in the direction indicated by an arrow mark E. As the slider 30 is moved in the direction indicated by the arrow mark E against the force generated by the resiliency of the pressure application springs 28*a*, 28*b* and 28*c*, the slanted surfaces 30*a*, 30*b* and 30*c* of the slider 30 move in the direction of the arrow mark E while pushing down the protrusions 25*e* and 25*f*, respectively, and pushing the protrusion 25*g* upward. Consequently, the primary transfer roller holders 25*a*, 25*b* and 25*c*, shown in FIG. 3, are pulled upward, and therefore, the primary transfer rollers 6*a*, 6*b* and 6*c* separate from the photosensitive drums 1*a*, 1*b* and 1*c*, respectively.

Referring to part (b) of FIG. 8, in the black monochromatic mode, the slider 30 keeps the primary transfer rollers 6*a*, 6*b* and 6*c*, in their highest position. The protrusions 25*e* and 25*f* are in their lowest positions, into which they were downwardly guided by the slanted surfaces 30*a* and 30*b*, and the protrusion 25*g* is its highest position, into which it is upwardly guided by the slanted surface 30*c*, respectively. Thus, the primary transfer rollers 6*a*, 6*b* and 6*c* remain separated from the photosensitive drums 1*a*, 1*b* and 1*c*.

When the image forming apparatus 100 is switched in operation mode from the black monochromatic mode to the full-color mode, the slider 30 is moved in the direction indicated by an arrow mark G. As the slider 30 is moved in the direction indicated by the arrow mark G, the protrusions 25*e*, 25*f* and 25*g* push the slanted surfaces 30*a*, 30*b* and 30*c* in the direction indicated by the arrow mark G. Therefore, the slider 30 is accelerated in the direction of the arrow mark G. Thus, the primary transfer roller holders 25*a*, 25*b* and 25*c* are moved downward by the pressure generated by the pressure application springs 28*a*, 28*b* and 28*c*. Consequently, the primary transfer rollers 1*a*, 1*b* and 1*c* press on the photosensitive drums 6*a*, 6*b* and 6*c*.

Referring to part (a) of FIGS. 8 and 8(*b*), in the full-color mode and black monochromatic mode, the slider 29 does not move the primary transfer roller 6*d* upward. Thus, the protrusion 25*h* is kept in contact with the slanted surface 29*a* by the pressure generated by the pressure application spring 28*d* shown in FIG. 3.

Referring to part (c) of FIG. 8, when the image forming apparatus 100 is changed in operational mode from the black monochromatic mode to the full-separation mode, the slider 29 is moved in the direction indicated by an arrow mark F. Thus, the protrusion 25*h* is guided downward by the slanted surface 29*a*, separating the primary transfer roller 6*d* from the photosensitive drum 1*d*.

As described above, the primary transfer roller 6*a*, which is an example of transfer roller, is movable in the direction to separate from, or come into contact with, the intermediary transfer belt 10*e*, which is an example of endless belt. The pressure application spring 28*a* which is an example of pressure applying means presses the primary transfer roller 6*a* toward the intermediary transfer belt 10*e*. The frame 43 which is an example of movable component movably supports the slider 30. The slider 30 which is an example of movable component can be moved on the frame 43 between the first and second position. The slider 30 separates the primary transfer roller 6*a* from the intermediary transfer belt 10*e* by being moved in the first direction, that is, the first-to-second direction, and places the primary transfer roller 6*a* in contact with the intermediary transfer belt 10*e* by being moved in the second direction, that is, the opposite direction from the first direction.

The motor 51 (FIG. 3) which is an example of driving force source provides the force for moving the slider 30 in the first direction. The cam 27 which is an example of slider moving component moves the slider 30 in the first direction by being given the driving force by the motor 51.

The pressure application spring 28*d* which is an example of the second pressure applying means, which is different from the pressure applying means as the first pressure applying means, presses the primary transfer roller 6*d* which is an example of the secondary transfer roller and is different from the transfer roller as the primary transfer roller, toward the intermediary transfer belt 10*e*. The slider 29, which is an example of the second movable component and is different from the movable component as the first movable component, is movable between the fourth and fifth positions. The slider 29 separates the primary transfer roller 6*d* by being moved in the second direction from the fourth position to the fifth position. The slider 29 places the primary transfer roller 6*d* in contact with the intermediary transfer belt 10*e* by being moved in the first direction which is opposite in direction from the second direction.

The cam 27 is a component which is driven by the motor 51. The cam 27 moves the slider 30 in the first direction against the pressure generated by the resiliency of the pressure application springs 28*a* and 28*b* which are examples of first and third pressure applying means, respectively. The cam 27 has the first surface 27*a* (FIG. 5) for moving the slider 30 in the first direction, and the second surface 27*b* (FIG. 5) for moving the slider 29 in the second direction. The first and second surfaces of the cam 27 put the image forming apparatus 100 in one of the three different modes, which correspond to the rotational angle of the cam 27.

In the full-color mode which is an example of the first mode, the first to fourth primary transfer rollers 6*a*, 6*b*, 6*c* and 6*d* are placed in contact with the intermediary transfer belt 10*e*. In the black monochromatic mode which is an example of the second mode, the primary transfer rollers 6*a*, 6*b* and 6*c* are separated from the intermediary transfer belt 10*e* while the primary transfer roller 6*d* is kept in contact with the above described endless belt. In the full-separation mode which is an example of the third mode, the primary transfer rollers 6*a*, 6*b*, 6*c* and 6*d* are moved in the direction to be separated from the intermediary transfer belt 10*e*.

The primary transfer roller 6*c* which is an example of the third transfer roller is separated, along with the primary transfer rollers 6*a* and 6*b*, from the intermediary transfer belt 10*e* by the movement of the slider 30 in the first direction. The pressure application spring 28*c* which is an example of the third pressure applying means keeps the primary transfer roller 6*c* pressured toward the intermediary transfer belt 10*e*. The primary transfer roller 6*d* forms the second transferring section for transferring a black toner image onto the intermediary transfer belt 10*e*. The primary transfer rollers 6*a* and 6*b* which are examples of the first and second transfer rollers form the first and second transferring sections for transferring toner images other than the black toner image onto the intermediary transfer belt 10*e*.

(Idler Roller Separation Mechanism)

Referring to part (a) of FIGS. 8 and 8(*b*), in the full-color mode and black monochromatic mode, the idler roller 10*f* remains rotatably supported by the idler roller bearings 40 which are rotatably supported by the frame 43. The idler roller bearing 40 remains pressed on the idler roller seat portion 29*b* of the slider 29 by the tension of the intermediary transfer belt 10*e*, being thereby appropriately positioned.

Referring to part (c) of FIG. 8, in the full-separation mode, the slider 29 is moved in the direction indicated by an arrow mark F. Thus, the idler roller bearing 40 is guided diagonally upward by the slanted surface 29*c*, causing thereby the idler roller 10*f* to move upward. Consequently, the intermediary transfer belt 10*e* retreats upward.

(Cam Actions in Various Modes)

FIG. 9 is a drawing for describing the cam action in each of the three modes. Part (a) of FIGS. 9, 9(*b*) and 9(*c*), show the positions into which the sliders 29 and 30 are moved as the cam 27 is rotated each time by 120° in one direction. Part (a) of FIGS. 8, 8(*b*) and 8(*c*) show the positional relationship between the sliders 29 and 30 when the cam 27 is in the positions shown in part (a) of FIGS. 9, 9(*b*) and 9(*c*).

Referring to FIG. 5, the cam 27 has the surface 27*b* for the slider 29, and the surface 27*a* for the slider 30. The intermediary transfer unit 10 is structured so that each time the cam 27 is rotationally moved by 120°, the sliders 29 and 30 are changed in movement.

Referring to part (a) of FIG. 9, in the full-color mode, the cam 27 moves both the sliders 29 and 30 leftward. Thus, the primary transfer rollers 6*a*, 6*b*, 6*c* and 6*d* are pressed against the photosensitive drums 1*a*, 1*b*, 1*c* and 1*d*, respectively, as shown in part (a) of FIG. 8.

Referring to part (b) of FIG. 9, as the cam 27 is rotated by 120° from the position in which it is in the full-color mode, in order to put the image forming apparatus 100 in the black monochromatic mode, the cam 27 moves the slider 30 rightward, but, it leaves the slider 29 in the left position. Thus, the primary transfer roller 6*a*, 6*b* and 6*c* separate from the photosensitive drums 1*a*, 1*b* and 1*c*, whereas the primary transfer roller 6*d* remains pressed against the photosensitive drum 1*d*, as shown in part (b) of FIG. 8.

Referring to part (c) of FIG. 9, as the cam 27 is rotated by 120° from the position in which it is in the black monochromatic mode, in order to put the image forming apparatus 100 in the full-separation mode, it moves the slider 29 rightward, but keeps the slider 30 in the right position. Thus, the primary transfer rollers 6*a*, 6*b*, 6*c* and 6*d* are separated from the photosensitive drums 1*a*, 1*b*, 1*c* and 1*d*, respectively, as shown in part (c) of FIG. 8.

As described above, the primary transfer rollers 6*a*, 6*b*, 6*c* and 6*d*, and idler roller 10*f* are appropriately positioned by the selective combination among the moving direction of the sliders 29 and 30, shapes and directions of the slanted surfaces 29*a*, 30*a*, 30*b* and 30*c* of the slider 29 and 30, and position of the idler roller seat section 29*b* of the slider 29, in order to place the primary transfer rollers 6*a*, 6*b*, 6*c* and 6*d* in contact with the intermediary transfer belt 10*e*, or separate them from the intermediary transfer belt 10*e*.

(Changes in Amount of Torque Necessary to Drive Cam)

The image forming apparatus 100 can be operated in three different modes, more specifically, full-color mode, black monochromatic mode, and full-separation mode, which are different in terms of the positioning of the primary transfer rollers 6*a*, 6*b*, 6*c* and 6*d*. Regarding the structural arrangement for positioning the primary transfer rollers 6*a*, 6*b*, 6*c* and 6*d* for the full-color mode, black monochromatic mode, or full-separation mode, the image forming apparatus 100 is structured so that as the cam 27 is rotated, the slider 30 is moved, whereby the primary transfer roller holders 25*a*, 25*b*, 25*c* and 25*d* which are in engagement with the slider 30 are moved.

Therefore, the greater the amount by which the primary transfer rollers 6*a*, 6*b*, 6*c* and 6*d* need to be moved, and/or the amount of the force (pressure) the pressure application springs 28*a*, 28*b*, 28*c* and 28*d* generate, the greater the amount of force necessary to move the slider 30, and therefore, the greater the amount of torque necessary to drive (rotate) the cam 27. Therefore, the motor for driving the cam 27 needs to be increased in size (capacity). Consequently, such issues may arise that the image forming apparatus 100 may have to be increased in size, which may result in increase in the apparatus cost. In addition, the image forming apparatus 100 may increase in the noises attributable to the motor for driving the cam 27. Moreover, the motor for driving the cam 27 may overheat.

Further, it is possible that when the primary transfer rollers 6*a*, 6*b*, 6*c* and 6*d*, which are remaining separated from the photosensitive drums 1*a*, 1*b*, 1*c* and 1*d*, are pressed against the photosensitive drums 1*a*, 1*b*, 1*c* and 1*d*, the slider 30 will be separated from the cam 27 by the force generated by the resiliency of the pressure application springs 25*a*, 25*b*, 25*c* and 25*d*, and collide with the frame 43. If such collision occurs, the image forming apparatus 100 generates percussive noises.

Referring to part (b) of FIG. 8, the home positions of the primary transfer rollers 6*a*, 6*b*, 6*c* and 6*d* (FIG. 3) of the intermediary transfer unit 10 are where the rollers 6 are when the image forming apparatus 100 is in the black monochromatic mode, which is highest in the frequency of usage among the aforementioned three modes. As the cam 27 which is positioned in terms of rotational angle for the black monochromatic mode, as shown in part (b) of FIG. 9, is rotated in the preset direction, the image forming apparatus 100 is changed in operational mode to the full-separation mode, shown in part (c) of FIG. 9, through the full-color mode shown in part (a) of FIG. 9.

When the image forming apparatus 100 is changed in operation mode from the full-color mode shown in part (a) of FIG. 9 to the full-separation mode shown in part (c) of FIG. 9, all of the four primary transfer rollers 6*a*, 6*b*, 6*c* and 6*d* have to be pulled up at the same time. Therefore, the amount of torque necessary to drive (rotate) the cam 27 is the largest, making it possible for a large amount of electric current to flow through the motor 51 for the cam 27.

In comparison, when the image forming apparatus 100 is changed in operation mode from the black monochromatic mode shown in part (b) of FIG. 9 to the full-color mode, the primary transfer rollers 6*a*, 6*b* and 6*c* are moved toward the photosensitive drums 1*a*, 1*b* and 1*c* to be pressed against the photosensitive drums 1*a*, 1*b* and 1*c* while remaining under the pressure generated by the resiliency of the pressure application springs 28*a*, 28*b* and 28*c*, respectively. Therefore, the amount of torque required to drive (rotate) the cam 27 is the smallest. Thus, if the slider 30 is moved by the force generated by the pressure application springs 28*a*, 28*b* and 28*c* before the starting of the rotation of the cam 27, percussive noises sometimes occur.

In this embodiment, therefore, the slider 30 is provided with an assisting mechanism 35 to assist the driving of the slider 30 when the image forming apparatus 100 is changed in operational mode from the full-color mode to the full-separation mode. Further, the assisting mechanism 35 controls (damps) the movement of the slider 30 when the image forming apparatus 100 is changed in operation mode from the black monochromatic mode to the full-color mode.

(Assisting Mechanism)

FIG. 10 is a drawing for describing the operation of the assisting mechanism, which occurs when the image forming apparatus 100 is changed in operational mode from the full-color mode to the full-separation mode. FIG. 11 is a drawing for describing the operation of the assisting mechanism, which occurs when the image forming apparatus 100 is changed in operation from the black monochromatic mode to the full-color mode. Parts (a) and (b) of FIG. 12 illustrate the changes which occur to the amount of force provided by the assisting mechanism as the image forming apparatus 100 is changed in operational mode.

Referring to part (b) of FIG. 8, when the slider 30 is moved by the cam 27 in the direction to separate primary transfer rollers 6*a*, 6*b* and 6*c* from the intermediary transfer belt 10*e*, the assisting mechanism 35 provides an additional amount of force for moving the slider 30, whereas when the slider 30 is moved by the cam 27 in the direction to press the primary transfer rollers 6*a*, 6*b* and 6*c*, against the photosensitive drums 1*a*, 1*b* and 1*c*, the assisting mechanism 35 brakes the movement of the slider 30. The assisting mechanism 35 generates such force that presses the slider 30 in the first direction indicated by an arrow mark G, with the use of a vertical slider 32 which is under the force (pressure) generated by a compression spring 33 in the direction perpendicular to the moving direction of the slider 30.

A horizontal slider 31 is fixed to the frame 43 of the intermediary transfer unit 10. It has a roughly horizontal surface 31*b*, and a slanted surface 31*c*. The vertical slider 32 is held by the guiding component of the slider 30 in such a manner that it is allowed to vertically slide. A compression spring is disposed between the vertical slider 32 and slider 30 to keep the vertical slider 32 pressured in the direction intersectional to the moving direction of the slider 30 in order to keep the bottom tip of the vertical slider 32 in contact with the surface 31*b* of the horizontal slider 31.

Referring to FIG. 10, when the image forming apparatus 100 needs to be changed in operational mode from the full-color mode to the black monochromatic mode, the slider 30 is to be moved in the first direction indicated by an arrow mark E. During the first half of the movement of the slider 30 in the first direction, the vertical slider 32 which is under the pressure generated by the compression spring 33 remains in contact with the horizontal surface 31*b* of the horizontal slider 31, and therefore, the slider 30 is not pressed in the first direction. However, during the second half of the movement of the slider 30 in the first direction, the vertical slider 32 which is under the pressure generated by the compression spring 33 comes into contact with, and remains in contact with, the slanted surface 31*c* of the horizontal slide 31. Therefore, the horizontal component of the pressure generated by the compression spring 33 presses the slider 31 in the first direction. Thus, during the movement of the slider 30 in the first direction, the amount of torque necessary to rotate the cam 27 is reduced by an amount equivalent to the amount by which the slider 30 is pressed in the first direction by the vertical slider 32.

Referring to FIG. 11, when the image forming apparatus 100 needs to be changed in operational mode from the black monochromatic mode to the full-color mode, the slider 30 is to be moved in the second direction indicated by an arrow mark G. During the movement of the slider 30 in the second direction, the vertical slider 32 slides on the slanted surface 31*c* of the horizontal slider 31 while progressively compressing the compression spring 33 from the beginning of the movement. Therefore, the horizontal component of the force generated by the compression spring 33 functions as resistance to the movement of the slider 30 in the second direction. Thus, the slider 30 is prevented from being jettisoned in the second direction before it begins to be moved by the cam 27. Therefore, it does not occur that the image forming apparatus 100 abruptly generates percussive noises.

Referring to part (a) of FIG. 12, during the changing of the image forming apparatus 100 in the operational mode to the black monochromatic mode, the slider 30 is moved in the first direction from the first position P1 to the second position P2. While the slider 30 is moved from the first position P to the third position P3, the vertical slider 32 attached to the slider 30 slides on the horizontal surface 31*b* of the horizontal slider 31. Then, the moment the slanted surface 31*c* arrives at the vertical slider 32 at the third position P3, the amount of force applied to the slider 30 in the first direction by the vertical slider 32 becomes the largest, as shown in part (b) of FIG. 12. Therefore, the amount of force generated by the pressure application spring 28 (28*a*, 28*b* and 28*c* in FIG. 3) in the direction to retard the movement of the slider suddenly reduces. Thereafter, as the slider 31 moves further, the compression spring 33 extends, reducing thereby the amount of pressure applied in the first direction by the assisting mechanism 35. However, even at the second position P2, which is the last position of the vertical slider 32 during the process for separating the primary transfer rollers 6*a*, 6*b*, 6*c* and 6*d* from the intermediary transfer belt 10*e*, the vertical slider 32 presses on the slanted surface 31*c* of the horizontal slider 31. Therefore, the load generated by the pressure application spring (28*a*, 28*b* and 28*c* in FIG. 3) in a direction to retard the movement of the slider 30 remains reduced.

As described above, the assisting mechanism 35 which is an example of auxiliary mechanism has the compression spring 33 which is capable of pressing the movable component in the first direction as the movable component moves in the first direction. It presses the movable component in the first direction while the slider 30 (movable component) is moved from the third position P3, which is between the first position P1 and second position P2, to the second position P2.

In the first embodiment, the vertical slider 32 which is an example of auxiliary mechanism is placed on the slider 30. It is capable of moving the vertical direction which is one of the directions intersectional to the moving direction of the slider 30. The horizontal slider 31 which is an example of guiding component is placed on the frame 43. It allows the vertical slider 32 to vertically move as the slider 30 is moved. The compression spring 33 which is an example of an auxiliary pressing means can press the slider 30 in the first direction by pressing on the slanted surface of the horizontal slider 31 through the vertical slider 32.

The horizontal slider 31 has the slanted surface 31*c* which is an example of guiding surface which vertically moves the vertical slider 32 as the slider 30 is moved. The horizontal slider 31 is shaped so that its slanted surface 31*c* changes in angle at a position which corresponds to the third position P3.

The assisting mechanism 35 begins to press the slider 30 in the first direction at the third position P3 where the torque (force for rotating cam 27) of the motor 51 is closer to its peak than at the first position.

Effects of Embodiment 1

In the first embodiment, the vertical slider 32 which is kept under the pressure generated in the direction perpendicular to the moving direction of the slider 30 is used to provide an additional amount of force for separating the primary transfer rollers 6. Therefore, the amount of torque required of the motor 51 during the operation for separating the primary transfer rollers is smaller than that required of the motor 51 in any of conventional intermediary transfer unit 10. Further, the vertical slider 32 is used to brake the movement of the slider, which occurs during the operation to press the primary transfer rollers against the photosensitive drums 1. Therefore, the intermediary transfer unit 10 in this embodiment is significantly lower than any of conventional intermediary transfer unit 10, in the amount of noises which an intermediary transfer unit generates while it is in operation. Therefore, the first embodiment makes it possible to realize an intermediary transfer unit which is smaller in the amount of torque the motor 51 is required during an operation in which the primary transfer rollers 6*a*, 6*b*, 6*c* and 6*d* are separated from the intermediary transfer belt 10*e* with the use of the cam 27, less in the noises it generates during its operation, and yet, smaller in size and lower in cost, than any conventional intermediary transfer unit.

In the first embodiment, the intermediary transfer unit is structured so that the slider 30 and vertical slider 32 slide on the lateral plates of the frame 43. Therefore, the mechanism for moving the primary transfer roller to positioning the rollers is less in overall thickness than any conventional mechanism. Therefore, it can be more compactly placed in the frame 43.

In the first embodiment, in terms of the first direction, the third position P3 corresponds to where the torque (force for rotating cam 27) of the motor 51 is closer to its peak than at the first position. Thus, the first embodiment can reduce the amount of force (torque) necessary to drive (rotate) the cam 27.

(Modification of Horizontal and Slanted Surfaces of Horizontal Slider)

FIG. 13 is a drawing for describing another example of a combination of the surface 31*b* and slanted surface 31*c* of the horizontal slider 31. In FIG. 12, the slanted surface 31*c* of the horizontal slider 31 was flat. However, the first embodiment is not intended to limit the present invention in terms of the configuration of the horizontal slider 31.

Referring to FIG. 13, the portion of the surface of the horizontal slider 31, which is between the third position P3 and the second position P2, may be given a curvature. By shaping the horizontal slider 31 so that the closer to the position which corresponds to the second position P2, the greater in angle the portion of the surface of the horizontal slider 31, which corresponds to the slanted surface 31*c*, it is possible to apply a large amount of pressure to the slider 30 in the first direction even at the second position P2. That is, the shape of the combination of the surface 31*b* and slanted surface 31*c* of the horizontal slider 31 does not need to be limited to the shape in the first embodiment. It may be variously modified.

Comparative Example 1

An intermediary transfer unit which does not have an assisting mechanism 35 like the one shown in part (b) of FIG. 8 is referred to as comparative example of intermediary transfer unit. In the case of a comparative intermediary transfer unit, if the amount (distance) by which the bearings for the primary transfer rollers 6*a*, 6*b* and 6*c* are moved is large, or the amount of the pressure applied to the primary transfer rollers 6*a*, 6*b* and 6*c* is large, the amount of force required to move the slider 30, that is, the amount of torque required to rotate the cam 27 is large. The greater the amount of torque necessary to rotate the cam 27, the greater in torque the motor for driving the cam 27 has to be, and therefore, the higher in rigidity the shaft 26, slider 29, and slider 30 have to be. Thus, the components of the intermediary transfer unit 10 may have to be increased in size. As a result, such problems occur that the image forming apparatus 100 has to be increased in size, increases in noises, and/or becomes unwantedly higher in temperature. Thus, the image forming apparatus 100 increases in production cost.

Moreover, if the slider 30 is moved by the pressure generated by the pressure application springs 28*a*, 28*b* and 28*c* before the cam 27 begins to move the slider 30 when the primary transfer rollers 6*a*, 6*b* and 6*c*, which were remaining separated from the intermediary transfer belt 10*e*, need to be pressed against the photosensitive drums 1*a*, 1*b* and 1*c*, percussive noises sometimes suddenly occur.

Comparative Example 2

As described above, in the case of the intermediary transfer unit disclosed in Patent document 1, the cam for driving the slider which is for pressing the intermediary transfer belt upon the photosensitive drums 1 is rectangular. This intermediary transfer unit structured as described above is referred to as the second comparative example of intermediary transfer unit. In the case of the second comparative example of intermediary transfer unit, the amount of force required to drive (rotate) the cam toward the end of the process of separating the primary transfer roller from the intermediary transfer belt is reduced by rectangularly shaping the cam.

In the case of the second comparative example, when the rectangular cam is rotated to separate the primary transfer rollers from the intermediary transfer belt, the range in which the torque necessary to rotate the cam can be reduced is narrow, and until the cam is rotated into the narrow range, the amount of torque necessary to rotate the cam cannot be reduced. In addition, during the process of separating the primary transfer rollers from the intermediary transfer belt, it is necessary to pass the area in which an arm is longer than the top dead center of the cam, which corresponds to the diagonal of the rectangular cam. Therefore, this comparative example is greater in the maximum torque which the motor 51 is required to rotate the cam than an example in which an oval cam is used.

Further, in the second comparative example, the image forming apparatus 100 is usable only in the black monochromatic mode and full-color mode. Therefore, a rectangular cam can be used. However, in the case of an image forming apparatus such as the one in the first embodiment which is provided with the three operational modes, that is, the black monochromatic mode, full-color mode, plus the full-separation mode, a rectangular cam cannot be used.

Embodiment 2

In the foregoing embodiment, the assisting mechanism 35 with which the image forming apparatus 100 is provided, as shown in part (a) of FIG. 8, to reduce the amount of torque necessary to move the slider 30 in the first embodiment. In comparison, in the second embodiment, the image forming apparatus 100 is provided with an assisting mechanism 35 for reducing the amount of torque necessary to move the slider 29.

(Assisting Mechanism)

Parts (a) and (b) of FIG. 14 illustrate the assisting mechanism in the second embodiment. Part (a) of FIG. 14 is for describing a tensioning mechanism, and part (b) of FIG. 14 is for describing an idler roller supporting mechanism. Referring to part (a) of FIG. 14, the tension roller 10*h*, which is one of the rollers which support and keep tensioned the intermediary transfer belt 10*e*, is rotatably supported by a pair of bearings 39, each of which is supported by a slider guide 39*a* in such a manner that it is allowed to move in the direction indicated by an arrow mark E, and also, in the direction indicated by an arrow mark G. The slider guide 39*a* is fixed to the frame 43. A compression spring 39*b* is disposed between the bearing 39 and frame 43. It provides the intermediary transfer belt 10*e* with a preset amount of tension, by pressing bearing 39 toward the intermediary transfer belt 10*e*.

Referring to part (c) of FIG. 8, as the slider 29 is moved in the direction indicated by an arrow mark F, the idler roller bearing 40 moves upward. Thus, the portion of the intermediary transfer belt 10*e*, which corresponds to the bottom portion of the belt loop, is allowed to move upward. As a result, the intermediary transfer belt 10*e* separates from the photosensitive drums 1*a*, 1*b*, 1*c* and 1*d* as shown in FIG. 1, making it possible for the intermediary transfer unit 10 to be pulled out of the housing 100A of the image forming apparatus 100, while preventing the intermediary transfer unit 10 from coming into contact with the photosensitive drums 1*a*, 1*b*, 1*c* and 1*d*.

Referring to part (b) of FIG. 14, the idler roller 10*f*, which is one of the rollers by which the intermediary transfer belt 10*e* is suspended and kept tensioned, is rotatably supported by the idler roller bearing 40. The idler roller bearing 40 holds the intermediary transfer belt 10*e* in the image forming position while remaining pressed upon the surface 29*b* (load bearing surface) of the slider 29 by the tension of the intermediary transfer belt 10*e*.

As the slider 29 is moved in the direction indicated by the arrow mark F, the idler roller bearing 40 remains in contact with the surface 29*b* of the slider 29. Then, as the slanted surface 29*c* of the slider 29 comes into contact with the idler roller bearing 40, the tension of the intermediary transfer belt 10*e* begins to cause the idler roller bearing 40 to push the slider 29 in the direction indicated by the arrow mark F, while allowing the idler roller bearing 40 to be moved upward by the tension of the intermediary transfer belt 10*e*. As the idler roller bearing 40 moves upward, the tension roller 10*h* moves in the direction indicated by the arrow mark G to keep the intermediary transfer belt 10*e* tensioned, as shown in part (a) of FIG. 14.

Referring to part (b) of FIG. 14, even after the idler roller 10*f* has moved to its highest position, the idler roller bearing 40 remains in contact with the slanted surface 29*c* of the slider 29, and continues to press the slider 29 in the direction indicated by the arrow mark F. On the other hand, as the slider 29 is moved in the opposite direction from the direction indicated by the arrow mark F, the tension of the intermediary transfer belt 10*e* works in a manner to apply braking force to the slider 29, by way of the slanted surface 29*c*. Therefore, it is avoided that the slider 29 is jettisoned in the opposite direction from the direction indicated by the arrow mark F, by the force generated by the pressure application spring 28*d* which is remaining compressed as shown in FIG. 3.

As described above, in the case of the slider 29, the assisting mechanism 36 assists the cam in moving the slider 29 in the direction indicated by the arrow mark F, and also, brakes the slider 29 when the slider 29 is moved in the opposite direction from the direction indicated by the arrow mark F.

As described above, in the second embodiment, the assisting mechanism 36 (FIG. 14) which is an example of second assisting mechanism, and is different from the assisting mechanism as the first assisting mechanism, assists the movement of the slider 29 in the second direction. The idler roller 10*f* which is an example of movable roller as an auxiliary movable component is one of the rollers which suspend and keep tensioned the intermediary transfer belt 10*e*, can place the portion of the intermediary transfer belt 10*e*, which corresponds to the bottom portion of the belt loop, in the image forming position, and, the home position.

The combination of the compression spring 39*b* which is an example of a tension providing mechanism as a pressure applying means, and the bearing 39, provides the intermediary transfer belt 10*e* with tension. The slider 29 has a guiding surface which guides the idler roller 10*f* when the slider 29 is moved in the second direction to move the intermediary transfer belt 10*e* to the home position (away from the photosensitive drums).

Embodiment 3

FIG. 15 is a drawing for describing the operation for assisting in the operation for changing the image forming apparatus 100 in operational mode from the full-color mode to the black monochromatic mode. FIG. 16 is a drawing for describing the assisting operation for assisting the operation for changing the image forming apparatus 100 in operational mode from the black monochromatic mode to the full-color mode. Referring to part (a) of FIG. 8, in the first embodiment, the horizontal slider 31 is fixed to the frame 43, and the vertical slider 32 and compression spring 33 are attached to move the slider 30 so that they moves with the slider 30. In comparison, in the third embodiment, the vertical slider 32 and compression spring 33 are attached to the frame 43, and the horizontal slider 31' is fixed to the slider 30, as shown in FIG. 14. Otherwise, the intermediary transfer unit in the third embodiment is the same in structure as the intermediary transfer unit in the first embodiment. Thus, the structural components, and their sections, of the intermediary transfer unit shown in FIGS. 14 and 15, which are the same in structure as the counterparts in the first embodiment are given the same referential codes as those given in FIG. 8, and are not described in order to avoid repeating the same descriptions.

Referring to FIG. 15, a slider 30' is attached to the frame 43 of the intermediary transfer unit 10 in such a manner that it can be moved in the horizontal direction (direction indicated by arrow mark E). The frame 43 is provided with an unshown guide, being enabled to hold the vertical slider 32 in such a manner that the vertical slider 32 can be vertically moved. There is disposed a compression spring 33 between the frame 43 and vertical slider 32. The horizontal slider 31' is fixed to the slider 30. The compression spring 33 presses the vertical slider 32 downward, keeping thereby the vertical slider 32 in contact with the mating surface 31*b* of the horizontal slider 31'.

When the image forming apparatus 100 is changed in operational mode from the full-color mode to the black monochromatic mode, the slider 30' is moved in the direction indicated by the arrow mark E to separate the primary transfer rollers 6*a*, 6*b* and 6*c* from the intermediary transfer belt 10*e* while compressing the pressure application springs 28*a*, 28*b* and 28*c*. As the slider 30' is moved, the mating surface 31*b* of the horizontal slider 31' moves away from the vertical slider 32. Eventually, the slanted surface 31*a* of the slider 31' comes into contact with the vertical slider 32. Thus, the force generated by the compression spring 33 begins to press the slider 30 in the direction indicated by the arrow mark E.

Referring to FIG. 16, when the image forming apparatus 100 is changed in operational mode from the black monochromatic mode to the full-color mode, the slider 30' is moved in the direction indicated by an arrow mark G, placing thereby the primary transfer rollers 6*a*, 6*b* and 6*c* in contact with the intermediary transfer belt 10*e* while remaining under the pressure generated by the pressure application springs 28*a*, 28*b* and 28*c*, as shown in FIG. 3. As the slider 30' is moved, the slanted surface 31*a* of the horizontal slider 31' moves while moving the vertical slider 32 upward, and therefore, compressing the compression spring 33. Therefore, it is avoided that the slider 30 is jettisoned in the direction indicated by the arrow mark G by the force generated by the resiliency of the pressure applications springs 28*a*, 28*b* and 28*c*.

As described above, in the third embodiment, the vertical slider 32 which is an example of assistive movable component is attached to the frame 43 in such a manner that it is allowed to move in the vertical direction which is an example of direction which is intersectional to the moving direction of the slider 30. The horizontal slider 31 which is an example of guiding component is attached to the slider 30, and guides the vertical slider 32 in such a manner that as the slider 30 is moved, the vertical slider 32 is vertically moved. The compression spring 33 which is an example of pressure applying assistive component is capable of pressing the slider 30 in the first direction, by pressing on the slanted surface of the horizontal slider 31 by way of the vertical slider 32.

Miscellaneous Embodiments

The preceding embodiments of the present invention are not intended to limit the present invention in scope. That is, the present invention is applicable to not only an image forming apparatus which forms a toner image on its photosensitive drum, and transfers the toner image onto a sheet of recording medium by way of its intermediary transfer belt, but also, an image forming apparatus which forms a toner image on its photosensitive drum, and transfers the toner image onto a sheet of recording medium borne on its transfer belt.

The means for rotating the cam does not need to be limited to a motor. That is, the present invention is also applicable to an image forming apparatus which employs a belt unit structured so that its cam is to be manually rotated with the use of a lever.

The assisting mechanism does not need to be a combination of a vertical slider, which is under the pressure generated by a spring, and a horizontal slider. It may be such a mechanism that does not have a power source, but, cumulatively stores the force generated by the resiliency of the movable component while the movable component is moved in one direction, and then, utilizes the stored force to assist the movement of the movable component at a preset position while the movable component is moved in the other direction.

The movement of the movable component does not need to be linear. That is, it may be rotational.

The assistive and damping effects of the assisting mechanism 35 can be optimized by modifying the horizontal slider 31 in the position of the joint between the slanted surface 31*a* and horizontal surface 31*b* according to the pattern in which the amount of torque necessary to rotate the cam 27 changes in relation to the rotational angle of the cam 27. Further, they can be also optimized by adjusting the compression spring 33 in the amount of resiliency according to the amount of torque necessary to rotate the cam 27.

Regarding the slanted surface 31*a* of the assisting mechanism, it does not need to be the horizontal slider 31 that is provided with the slanted surface (31*a*). That is, it may be the vertical slider 32 that is provided with the slanted surface (32*a*). In other words, the effects of the assisting mechanism 35 are the same whether the slanted surface (31*a*) is a part of the horizontal slider 31 or vertical slider 32.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-011551 filed on Jan. 23, 2015, which is hereby incorporated by reference herein in its entirety.

What is claimed is:

1. An image forming apparatus comprising:

an image bearing member configured to carry a toner image;

an endless belt;

a belt frame configured to support a plurality of stretching rollers for stretching said belt;

a transfer roller provided inside of said belt configured to contact an inner surface of said belt to transfer the toner image from said image bearing member onto said belt;

a first urging member provided between said belt frame and said transfer roller and configured to urge said transfer roller toward said image bearing member through said belt;

a movable member movable relative to said belt frame in a first direction and movable between a first position for moving said transfer roller to a contact position where said transfer roller contacts the inner surface of said belt and a second position for moving said transfer roller to a spaced position where said transfer roller is spaced from the inner surface of said belt;

a driving source configured to move said movable member relative to said belt frame, said driving source receiving a load attributable to said first urging member when said driving source moves said movable member from the first position to the second position; and a load reducing mechanism configured to reduce the load of said driving source when said driving source moves said movable member from a third position which is between the first position and the second position to the second position, said load reducing mechanism including a first member, a second urging member and a second member, wherein said first member is provided on said movable member so as to be movable in a second direction crossing with the first direction, and said first member includes a first contact portion, wherein said second urging member is disposed between said movable member and said first member and urges said first member in the second direction relative to said movable member, and wherein said second member is fixed to said belt frame and includes a second contact portion which contacts said first contact portion when said movable member is between the third position and the second position, wherein said second member is cooperative with said first member to convert an urging force of said second urging member to said first member in the second direction to a force to said movable member in the first direction, and the converted force in the first direction reduces the load of said driving source driving said movable member from the third position to the second position.

2. An apparatus according to claim 1, wherein at least one of said first contact portion and said second contact portion is provided with an inclined surface inclined relative to the first direction.

3. An apparatus according to claim 1, wherein said second member includes a third contact portion adjacent to said second contact portion in the first direction, and said third contact portion has a surface in the first direction which contacts said first contact portion when said movable member is between the first position and the third position.

4. An apparatus according to claim 1, further comprising a holder configured to rotate said transfer roller about a rotational shaft supported by said belt frame between the contact position and the spaced position, wherein one end portion side of said holder rotatably supports said transfer roller, and said first urging member is disposed between the other end portion side of said holder and said belt frame, and wherein the other end portion side of said holder is provided with a projection configured to limit rotation of said holder by contacting a regulating surface of said movable member and urged by the urging force of said first urging member.

5. An apparatus according to claim 1, further comprising a holder movably provided on said belt frame and rotatably supporting said transfer roller and configured to move said transfer roller between the contact position and the spaced position, wherein one end portion side of said holder rotatably supports said transfer roller, and said first urging member is disposed between the other end portion side of said holder and said belt frame, and wherein said holder is provided with a projection configured to limit rotation of said holder by contacting a regulating surface of said movable member and urged by the urging force of said first urging member.

6. An image forming apparatus comprising:

an image bearing member configured to carry a toner image;

an endless belt;

a belt frame configured to support a plurality of stretching rollers for stretching said belt;

a transfer roller provided inside of said belt configured to contact an inner surface of said belt to transfer the toner image from said image bearing member onto said belt;

a first urging member provided between said belt frame and said transfer roller and configured to urge said transfer roller toward said image bearing member through said belt;

a movable member movable relative to said belt frame in a first direction and movable between a first position for moving said transfer roller to a contact position where said transfer roller contacts the inner surface of said belt and a second position for moving said transfer roller to a spaced position where said transfer roller is spaced from the inner surface of said belt;

a driving source configured to move said movable member relative to said belt frame, said driving source receiving a load attributable to said first urging member when said driving source moves said movable member from the first position to the second position; and a load reducing mechanism configured to reduce the load of said driving source when said driving source moves said movable member from a third position which is between the first position and the second position to the second position, said load reducing mechanism including a first member, a second urging member and a second contact portion, wherein said first member is provided on said belt frame so as to be movable in a second direction crossing with the first direction, and said first member includes a first contact portion, wherein said second urging member is disposed between said belt frame and said first member and urges said first member in the second direction relative to said belt frame, and wherein said second contact portion is provided on said movable member and contacts said first contact portion when said movable member is between the third position and the second position, wherein said second contact portion is cooperative with said first member to convert an urging force of said second urging member to said first member in the second direction to a force to said movable member in the first direction, and the converted force in the first direction reduces the load of said driving source driving said movable member from the third position to the second position.

7. An apparatus according to claim 6, wherein at least one of said first contact portion and said second contact portion is provided with an inclined surface inclined relative to the first direction.

8. An apparatus according to claim 6, wherein said movable member includes a third contact portion adjacent to said second contact portion in the first direction, and said third contact portion has a surface in the first direction which contacts said first contact portion when said movable member is between the first position and the third position.

9. An apparatus according to claim 6, further comprising a holder configured to rotate said transfer roller about a rotational shaft supported by said belt frame between the contact position and the spaced position, wherein one end portion side of said holder rotatably supports said transfer roller, and said first urging member is disposed between the other end portion side of said holder and said belt frame, and wherein the other end portion side of said holder is provided with a projection configured to limit rotation of said holder by contacting a regulating surface of said movable member and urged by the urging force of said first urging member.

10. An apparatus according to claim 6, further comprising a holder movably provided on said belt frame and rotatably supporting said transfer roller and configured to move said transfer roller between the contact position and the spaced position, wherein one end portion side of said holder rotatably supports said transfer roller, and said first urging member is disposed between the other end portion side of said holder and said belt frame, and wherein said holder is provided with a projection configured to limit rotation of said holder by contacting a regulating surface of said movable member and urged by the urging force of said first urging member.

11. An image forming apparatus comprising:

an image bearing member configured to carry a toner image;

an endless belt;

a belt frame configured to support a plurality of stretching rollers, including a first stretching roller and a second stretching roller, for stretching said belt;

a transfer roller provided inside of said belt configured to contact an inner surface of said belt to transfer the toner image from said image bearing member onto said belt;

a first urging member provided between said belt frame and said transfer roller and configured to urge said transfer roller toward said image bearing member through said belt;

a movable member movable relative to said belt frame in a first direction and movable between a first position for moving said transfer roller to a contact position where said transfer roller contacts the inner surface of said belt and a second position for moving said transfer roller to a spaced position where said transfer roller is spaced from the inner surface of said belt;

a driving source configured to move said movable member relative to said belt frame, said driving source receiving a load attributable to said first urging member when said driving source moves said movable member from the first position to the second position; and a load reducing mechanism configured to reduce the load of said driving source when said driving source moves said movable member from a third position which is between the first position and the second position to the second position, said load reducing mechanism including said first stretching roller, a second urging member and a second contact portion, wherein said first stretching roller is provided on said belt frame so as to be movable in a second direction crossing with the first direction, and said first stretching roller includes a first contact portion, wherein said second urging member is disposed between said belt frame and said second stretching roller and urges said first stretching roller in the second direction through said belt relative to said belt frame, and wherein said second contact portion is provided on said movable member and contacts said first contact portion when said movable member is between the third position and the second position, wherein said second contact portion is cooperative with said first stretching roller to convert an urging force of said second urging member to said first stretching roller in the second direction to a force to said movable member in the first direction, and the converted force in the first direction reduces the load of said driving source driving said movable member from the third position to the second position.

12. An apparatus according to claim 11, wherein at least one of said first contact portion and said second contact portion is provided with an inclined surface inclined relative to the first direction.

13. An apparatus according to claim 11, wherein said movable member includes a third contact portion adjacent to said second contact portion in the first direction, and said third contact portion has a surface in the first direction which contacts said first contact portion when said movable member is between the first position and the third position.

14. An apparatus according to claim 11, further comprising a holder configured to rotate said transfer roller about a rotational shaft supported by said belt frame between the contact position and the spaced position, wherein one end portion side of said holder rotatably supports said transfer roller, and said first urging member is disposed between the other end portion side of said holder and said belt frame, and wherein the other end portion side of said holder is provided with a projection configured to limit rotation of said holder by contacting a regulating surface of said movable member and urged by the urging force of said first urging member.

15. An apparatus according to claim 11, further comprising a holder movably provided on said belt frame and rotatably supporting said transfer roller and configured to move said transfer roller between the contact position and the spaced position, wherein one end portion side of said holder rotatably supports said transfer roller, and said first urging member is disposed between the other end portion side of said holder and said belt frame, and wherein said holder is provided with a projection configured to limit rotation of said holder by contacting a regulating surface of said movable member and urged by the urging force of said first urging member.

* * * * *